US008316683B2

(12) United States Patent
Tomizawa et al.

(10) Patent No.: US 8,316,683 B2
(45) Date of Patent: Nov. 27, 2012

(54) METHOD OF MANUFACTURING A BENT PRODUCT AND AN APPARATUS AND A CONTINUOUS LINE FOR MANUFACTURING THE SAME

(75) Inventors: Atsushi Tomizawa, Minou (JP); Naoki Shimada, Osaka (JP); Fumihiko Kikuchi, Tokyo (JP); Shinjiro Kuwayama, Osaka (JP)

(73) Assignees: Sumitomo Metal Industries, Ltd., Osaka (JP); Sumitomo Pipe & Tube Co., Ltd., Ibaraki (JP)

( * ) Notice: Subject to any disclaimer, the term of this patent is extended or adjusted under 35 U.S.C. 154(b) by 497 days.

(21) Appl. No.: 12/572,606

(22) Filed: Oct. 2, 2009

(65) Prior Publication Data

US 2010/0088882 A1 Apr. 15, 2010

Related U.S. Application Data

(63) Continuation of application No. PCT/JP2008/056368, filed on Mar. 31, 2008.

(30) Foreign Application Priority Data

Apr. 4, 2007 (JP) ..... 2007-098731

(51) Int. Cl.

| | |
|---|---|
| ***B21D 7/00*** | (2006.01) |
| ***B21D 37/16*** | (2006.01) |
| ***B21K 29/00*** | (2006.01) |
| ***B21B 39/00*** | (2006.01) |

(52) U.S. Cl. ..... 72/369; 72/128; 72/250; 72/342.94

(58) Field of Classification Search ..... 72/128, 72/166, 169, 200, 250, 342.2, 342.5, 342.6, 72/342.94, 367.1, 369

See application file for complete search history.

(56) References Cited

U.S. PATENT DOCUMENTS

| | | | | |
|---|---|---|---|---|
| 2,480,315 | A * | 8/1949 | Bennett | 72/128 |
| 7,621,164 | B2 * | 11/2009 | Fullerton et al. | 72/284 |
| 2002/0174700 | A1 * | 11/2002 | Meliga | 72/166 |

FOREIGN PATENT DOCUMENTS

| | | | |
|---|---|---|---|
| DE | 3634672 | A * | 4/1988 |
| EP | 1857195 | | 11/2007 |

(Continued)

OTHER PUBLICATIONS

Machine translation of DE3634672 Stender, p. 1.*

*Primary Examiner* — Teresa M Ekiert
(74) *Attorney, Agent, or Firm* — Clark & Brody

(57) ABSTRACT

A product intermittently having a bent portion which curves three-dimensionally and a quenched portion is manufactured by performing bending downstream of a support means while feeding a metal material which is supported by the support means from an upstream side towards a downstream side. A portion of the metal material is heated by a heating means downstream of the support means. A bending moment is imparted to the portion of the metal material heated by the heating means to three-dimensionally change the position of a movable roller die which is disposed downstream of the heating means and has a plurality of rolls which feed the heated metal material in the axial direction, and the metal material is quenched by spraying a cooling medium at the portion of the metal material which was heated by a cooling means disposed between the heating means and the movable roller die.

14 Claims, 23 Drawing Sheets

FOREIGN PATENT DOCUMENTS

| | | |
|---|---|---|
| JP | 50-59263 | 5/1975 |
| JP | 3022036 | 1/1994 |
| JP | 2816000 | 8/1998 |
| JP | 2000-158048 | 6/2000 |
| JP | 3195083 | 6/2001 |
| WO | WO2006/093006 | 9/2006 |

* cited by examiner (a)

(b)

(a)

(b)

METHOD OF MANUFACTURING A BENT PRODUCT AND AN APPARATUS AND A CONTINUOUS LINE FOR MANUFACTURING THE SAME

This application is a continuation of International Patent Application No. PCT/JP2008/056368, filed Mar. 31, 2008. This PCT application was not in English as published under PCT Article 21(2).

TECHNICAL FIELD

This invention relates to a method of manufacturing a bent product (a product formed by bending), and a manufacturing apparatus and a continuous manufacturing line therefor. More particularly, it relates to a manufacturing method, a manufacturing apparatus, and a continuous manufacturing line which can perform efficient and high-accuracy manufacture of a bent product by bending in which the bending direction varies two-dimensionally such as S-bending or by bending in which the bending direction varies three-dimensionally.

BACKGROUND ART

In recent years, out of concern for the global environment, lightweight and high-strength materials has been demanded for use as structural metal materials.

For example, in automobiles, there has been an increased demand for safety of automobile bodies, there is an increased demand for decreases in weight and increases in the strength of automobile parts, and the development of automobile parts is being advanced from the standpoints of increasing fuel efficiency and increasing safety in collisions. In order to cope with such demands, high-strength materials having a significantly higher strength level than in the past such as high tensile strength steel sheet having a tensile strength of at least 780 MPa or even at least 900 MPa are much used.

Along with an increase in the strength of such materials, there has been a rethinking of the structure of automobile parts. For example, in order to have applications to a variety of automobile parts, there is a strong demand for development of bending techniques which can perform high precision working of products having a widely varying bent shape, such as products having continuous bending in which the bending direction varies two-dimensionally as in S-bending, or continuous bending in which the bending direction varies three-dimensionally.

In order to meet such a demand, in Patent Document 1, for example, an invention which relates to a method of bending while performing heat treatment of a metal pipe or the like is disclosed in which the end portion of a member being worked such as a metal pipe is held by a rotatable arm, a portion of the metal material is heated by a heating device while the heated portion is suitably moved to produce bending deformation, and then cooling is carried out. Patent Document 2 discloses an invention related to a method of bending while performing heat treatment of a metal pipe or the like by applying a twisting force and a bending force to a heated portion of a metal pipe and carrying out bending deformation while twisting the metal pipe.

Taking into consideration decreases in the weight of products formed by bending, it is desirable to set their tensile strength to at least 900 MPa and more preferably to at least 1300 MPa. In this case, as disclosed in Patent Documents 1 and 2, bending is carried out on a starting material in the form of a pipe having a tensile strength of around 500-700 MPa, after which the strength is increased by heat treatment to manufacture a bent product having a desired high strength.

However, the inventions disclosed in Patent Documents 1 and 2 both relate to working methods which fall into the category of so-called grip bending. In order to carry out either invention, it is necessary to hold the end portion of a member being worked with a rotatable arm. Therefore, the member being worked cannot be fed at a high speed, and each time gripping of the member being worked by the arm is repeated, it is necessary to return the arm, so the feed speed of the member being worked greatly fluctuates, it becomes difficult to control the cooling rate in a complicated manner, and a desired hardening accuracy cannot be achieved.

It becomes necessary to control the heating and cooling rate in a complicated manner, but even if doing so, non-uniform strains develop, and a desired hardening accuracy cannot be guaranteed. Therefore, variations in the bent shape develop, and when dealing with a high-strength material, delayed fracture due to residual stresses occurs, and it is difficult to manufacture an automobile part requiring high reliability.

In Patent Document 3, an invention is disclosed which relates to a bending apparatus with high-frequency heating. A material being worked which is supported by a support means while being fed from an upstream side towards a downstream side by a feed device is subjected to bending on the downstream side of the support apparatus by compression bending rollers which are supported so as to be able to move three-dimensionally. According to the bending apparatus with high-frequency heating disclosed in Patent Document 3, the compression bending rollers straddle the material to be worked and move to opposite sides of the material being worked and perform bending while contacting the side surfaces. Therefore, even when performing continuous bending such as S-bending in which the bending direction varies two-dimensionally, there is no need to carry out a setup operation in which the material being worked is rotated by 180°, and bending can be efficiently carried out.

However, in the bending apparatus with high-frequency heating disclosed in Patent Document 3, there is no means for clamping both side surfaces of the material being worked. Therefore, deformation caused by residual stress due to cooling after high frequency heating easily occur, which makes it difficult to guarantee a prescribed dimensional accuracy. In addition, there are limitations on the working speed and it is difficult to increase the degree of working.

Patent Document 4 discloses an invention related to a bending apparatus. In place of the compression bending rollers of the above-described grip bending or bending apparatus with high-frequency heating, it includes a fixed die which is stationary and a movable gyro-die which can move three-dimensionally and is spaced from the fixed guide. In addition, a heating means is provided so as to heat a metal material being worked to a temperature corresponding to the curvature during bending by the movable gyro-die.

The fixed die and the movable gyro-die which constitute the bending apparatus disclosed in Patent Document 4 do not hold a metal material which is a material being worked so that it can rotate. Therefore, the surfaces of both the fixed die and the movable gyro-die easily develop seizing scratches when holding the metal material. The bending apparatus disclosed in Patent Document 4 supplies a cooling fluid to the fixed die and the movable gyro-die in order to prevent a decrease in the strength of the die and to prevent a decrease in working accuracy due to thermal expansion. However, supply of the cooling fluid is not for the purpose of quenching heat treatment of the metal material being bent, so it is not possible to manufacture a bent product having a high strength such as at least 900 MPa by quenching.

The bending apparatus disclosed in Patent Document 4 is not intended to obtain a high-strength metal material by using a low-strength metal pipe as a starting material and then increasing its strength by quenching after hot working. In addition, due to heating of the metal material, the surface of the movable gyro-die easily develops seizing scratches, so further improvements as a bending apparatus is needed.

In Patent Document 5, the present applicants disclosed an invention which manufactures a bent product with high efficiency while maintaining a sufficient bending accuracy using a bending method which carries out bending downstream of a support means while a metal material held by the support means is fed by a feed device from the upstream side towards the downstream side. When manufacturing a bent product with this method, a portion of the metal material is heated to a temperature range in which it can be locally quenched by a heating means for the metal material downstream of the support means, and the position of a movable roller die which is disposed downstream of the heating means and has at least one set of roll pairs which can support the metal material while feeding it is varied two-dimensionally or three-dimensionally to apply a bending moment to a portion of the metal material being fed which was heated by the heating means and carry out bending.

Patent Document 1: JP 50-59263 A
Patent Document 2: Japanese Patent 2816000
Patent Document 3: JP 2000-158048 A
Patent Document 4: Japanese Patent 3195083
Patent Document 5: WO2006/093006

DISCLOSURE OF INVENTION

Problem which the Invention is to Solve

According to the invention disclosed in Patent Document 5, a bent product which continuously or intermittently has a bent portion which is bent two-dimensionally or three-dimensionally and a quenched portion in the lengthwise direction and/or the circumferential direction in a plane crossing the lengthwise direction can be manufactured with certainty while guaranteeing a sufficient bending accuracy and a high operating efficiency.

Of course, in order to increase the accuracy of assembly of an automobile, it is necessary to further increase the dimensional accuracy of each of the parts constituting an automobile. In addition, due to automation of each of the assembly steps of an automobile including a welding step, there is a demand for even higher dimensional accuracy of each part.

For example, in recent years, laser welding which has begun to be employed for welding of automobile bodies can increase the welding speed compared to conventional spot welding, so it can not only increase productivity but can also reduce the size of heat affected zones by welding, so an extremely high weld quality can be obtained. In addition, laser welding makes it possible to perform continuous welding, so it is effective in increasing the stiffness of automobile bodies and thereby suppressing vibrations and noise. However, it is necessary for laser welding to maintain a precise depth of focus of a laser, so compared to conventional spot welding, a higher dimensional accuracy is demanded of portions to be welded in a panel. Therefore, it is necessary to increase the dimensional accuracy of each part. Accordingly, with the invention disclosed in Patent Document 5 as well, there is a need to manufacture a bent product having a higher dimensional accuracy.

The present invention was made in light of the problems of such prior art, and its object is to provide a manufacturing method, a manufacturing apparatus, and a continuous manufacturing line of a bent product which can guarantee a high working accuracy and excellent operating efficiency even when diverse bent shapes are required when performing bending of a metal material as a result of diversification of the structure of automobile parts and even when it is necessary to perform bending of a high-strength metal material.

Means for Solving the Problem

FIG. 33 is an explanatory view showing a working method which the present applicants disclosed in Patent Document 5. In FIG. 33, a metal material 41 which is fed to the left while being supported by two pairs of support rollers 40 is rapidly locally heated by a high-frequency heating coil 42 and then cooled by a cooling device 43 to perform quenching. The position of a movable roller die 44 which is disposed on the exit side of the cooling device 43 is varied two-dimensionally or three-dimensionally by a shifting amount H and a tilt θ to impart a bending moment to the portion 41*a* which is heated to a hot state by the high-frequency heating coil 42, whereby this portion 41*a* is deformed and continuous bending is thus carried out.

The present inventors investigated the cause of a decrease in the working accuracy in this working method by means of various experiments having the object of further increasing the dimensional accuracy, i.e., the working accuracy of a product worked by this working method. As a result, they found that at the start of working, the metal material 41 which is worked and cooled is supported by line (linear) contact with the movable roller die 44, and the metal material 41 being worked can maintain this contact position. However, as working proceeds, the weight acting on the metal material 41 of the portion which has passed through the movable roller die 44 unavoidably increases, so the metal material 41 rotates about the position of line contact with the movable roller die 44 and deforms the heated portion 41*a*.

In addition, it was also found that due not only to the weight of the metal material 41*a* but due to thermal deformation of the metal material 41*a* caused by non-uniformity of heating by the high-frequency heating coil 42 and cooling by the cooling device 43 and various disturbances of working conditions such as variations in the metal material 41*a*, additional rotation of the metal material 41 is produced, causing the working accuracy to decrease.

As a result of further investigations by the present inventors, it was found that by supporting and restraining the portion of the metal material 41*a* which has passed through the movable roller die 44 with a suitable support means, rigid-body (uniform) rotation of the metal material 41 due to disturbances can be suppressed, and as a result, the working accuracy can be further increased. As a result of this finding, the present invention was completed.

Thus, the present invention is a method of manufacturing a bent product which intermittently or continuously has a bent portion which is two-dimensionally or three-dimensionally bent and a quenched portion in the lengthwise direction and/or in the circumferential direction in a plane crossing the lengthwise direction using a bending technique which performs bending downstream of a support means while feeding a metal material to be worked which is supported by the support means from an upstream side towards a downstream side with a feed device, characterized in that a portion of the fed metal material is locally heated to a temperature such that quenching is possible by a heating means for the metal material downstream of the support means, at least a portion of the metal material is quenched by spraying a cooling medium towards the portion heated by the heating means by a cooling means disposed downstream of the heating means, bending of the metal material is carried out by imparting a bending moment to the portion of the metal material being fed in the axial direction which has been heated by the heating means by two-dimensionally or three-dimensionally varying the position of a movable roller die having a plurality of rolls which can feed the metal material which was heated by the heating means in the axial direction, and the portion of the metal material which has passed through the movable roller die is supported in order to suppress errors in the bent product.

From another standpoint, the present invention is an apparatus for manufacturing a bent product which intermittently or continuously has a bent portion which is two-dimensionally or three-dimensionally bent and a quenched portion in the lengthwise direction and/or the circumferential direction in a plane crossing the lengthwise direction by carrying out bending downstream of a support means while feeding a material to be worked in the form of a metal material which is supported by the support means from an upstream side towards a downstream side with a feed device, characterized by comprising (i) a heating means which surrounds the outer periphery of the metal material downstream of the support means and which is designed to heat a portion of the metal material to, for example, a temperature range such that the metal material can be locally quenched when the metal material is made of steel, and a cooling means which is disposed downstream of the heating means and which is designed to rapidly cool (or quench when the metal material is made of steel) the portion heated by the heating means by spraying a cooling medium on the portion, (ii) a movable roller die which is disposed downstream of the heating means such that its position can be varied two-dimensionally or three-dimensionally, which has a plurality of rolls capable of supporting the metal material which was heated by the heating means such that the metal material can move in the axial direction, and which carries out bending by imparting a bending moment to the portion of a metal material being fed in the axial direction which has been heated by the heating means, and (iii) a support guide which is disposed downstream of the movable roller die and which suppresses errors in the metal material after bending by supporting a portion of the metal material which has passed through the movable die.

This manufacturing apparatus for a bent product can be used not only when the metal material is made of steel, but also when the metal material is made of a metal other than steel such as an aluminum alloy.

FIGS. 34(*a*) and 34(*b*) are explanatory views of a support guide for supporting a portion of a metal material 41 which has passed through a movable roller die 44.

In FIG. 34(*a*), another roller die 45 is disposed as a support guide for a portion of the metal material has passed through the movable roller die 44. By increasing the number of portions with line contact by the rollers 45*a* of the roller die 45, rigid-body rotation due to disturbances of the metal material 41 can be suppressed.

In FIG. 34(*b*), the leading end of a metal material 41 which has passed through the movable roller die 44 is clamped by a clamping device 47 which is provided as a support guide. The clamping device 47 is supported by a general-purpose multi-axis articulated robot 46 and can be moved in synchrony with feeding of the metal material 41. As a result, rigid-body rotation caused by disturbances of the metal material 41 can be suppressed.

Preferably in the present invention, (a) the cooling medium is sprayed at an angle (obliquely) with respect to the direction in which the metal material is fed, and by changing the distance of the cooling means from the metal material in a direction parallel to a direction perpendicular to the axial direction of the metal material, the position where cooling starts in the circumferential direction of the metal material is varied and the region in the axial direction where the metal material is heated is adjusted, or b) a portion of the metal material which is being fed is nonuniformly heated in the circumferential direction by changing the distance of the heating means from the metal material in a direction parallel to a direction perpendicular to the axial direction of the metal material.

In a method of manufacturing a bent product according to the present invention, (c) the metal material is preferably heated a plurality of times by using at least one preheating means for the metal material provided upstream of the heating means, or (d) a portion of the fed metal material is preferably nonuniformly heated in the circumferential direction by using at least one preheating means for the metal material provided upstream of the heating means.

In the present invention, a synchronizing means which can synchronize the position of the support guide with the position of the movable roller die is preferably provided.

According to the present invention, when performing bending of a metal material, heat treatment is carried out while the metal material is supported on the downstream side and moved at a constant speed, so it is possible to guarantee an appropriate cooling rate. As a metal material which has undergone bending is uniformly cooled, a metal material which has a high strength and good shape retention and a uniform hardness can be obtained.

For example, a cooling rate of at least 100° C. per second can be achieved by continuously heating a steel pipe which is a material being worked by a high-frequency heating coil to a temperature which is at least the $A_3$ transformation point and at which the crystal grains constituting the metal structure do not coarsen, subjecting the heated portion to plastic deformation using a movable roller die so as to form a predetermined bent shape, and then immediately spraying with a water- or oil-based cooling medium or other cooling liquid or a gas or a mist at the outer surface or at the inner surface and the outer surface of the steel pipe which underwent bending.

The movable roller die which imparts a bending moment supports the metal material with movable rollers, so it can suppress seizing scratches on the surface of the die, and bending can be carried out efficiently. Similarly, the support means holds the metal material so as to be able to rotate, so the occurrence of seizing scratches can be suppressed.

In the present invention, the movable roller die preferably has at least one mechanism selected from a shifting mechanism for up and down movement, a shifting mechanism for shifting in the horizontal direction (to the left and right) perpendicular to the axial direction of the metal material, a tilting mechanism for tilting with respect to the vertical direction, and a tilting mechanism for tilting with respect to the horizontal direction perpendicular to the axial direction of the metal material. As a result, it is possible to impart a wide variety of bending shape to a metal material, and bending can be efficiently carried out even in the case of continuous bending in which the bending direction varies two-dimensionally or three-dimensionally.

In this case, the movable roller die preferably has a moving mechanism for moving in the axial direction (forwards and backwards) of the metal material. By having a moving mechanism for forwards and backwards movement, an optimal arm length L can be maintained even when the bending radius of the metal material is small. As a result, the bending accuracy can be maintained while an increase in the size of a working apparatus can be avoided.

In the present invention, the heating means and/or the cooling means preferably has at least one mechanism selected from a shifting mechanism for up and down movement, a shifting mechanism for shifting in the horizontal direction (to the left and right) perpendicular to the axial direction of the metal material, a tilting mechanism for tilting with respect to the vertical direction, and a tilting mechanism for tilting with respect to the horizontal direction perpendicular to the axial direction of the pipe member. As a result, the operation of the movable roller die, the heating means, and the cooling means can be synchronized, and due to this synchronization, uniform bending with greater accuracy becomes possible.

In this case, the heating means and/or the cooling means preferably has a moving mechanism for moving in the axial direction of the metal material. By providing the heating means, etc. with such a moving mechanism, in addition to synchronization with the movable roller die, heating of the end of the metal pipe at the start of bending becomes possible, and the ease of mounting and dismounting of the metal pipe and operability are improved.

In the present invention, the movable roller die preferably has a rotating mechanism for rotating in the circumferential direction about the axis of metal material. Twisting deformation can be added to a bent shape in which the bending direction may vary two-dimensionally or three-dimensionally.

In the present invention, the feed device preferably has a mechanism which grips the metal material and rotates it about its axis in the circumferential direction.

Even when a rotating mechanism of the movable roller die is not used, twisting deformation can be added to a bent shape in which the bending direction may vary two-dimensionally or three-dimensionally.

In this case, the support means preferably has a rotating mechanism for rotation in the circumferential direction of the metal material about its axis in synchrony with the rotation of the feed device. When the metal material undergoes twisting deformation, by twisting the rear end of the metal material by the rotating mechanism of the feed device in synchrony with the support means without rotating in the circumferential direction of the movable roller die, twisting deformation can be imparted with higher accuracy. Of course, it is also possible to impart twisting deformation with higher accuracy by producing relative twisting of the rear end of the metal material by the rotating mechanism of the feed device in synchrony with the support means while rotating the movable roller die in the circumferential direction about the axis.

In the present invention, the movable roller die preferably has a rotational drive mechanism capable of rotating each roll pair constituting the roller die, for example, a drive motor or the like in accordance with the amount of feed of the feed device. Namely, if the movable roller die does not have a rotational drive mechanism, its rolls are made to rotate only by frictional resistance, so compressive stresses act during bending, and the increase in wall thickness on the inner side of a bent portion may become large or buckling may develop. Particularly when the material being worked is a thin-walled material, due to these problems, bending may become difficult or the working accuracy may decrease.

In contrast, when the movable roller die has a rotational drive mechanism, the compressive stress acting on the portion undergoing bending is reduced, and by varying the rotational speed of the rolls of the movable roller die in accordance with the amount of feed of the feed device and in synchrony therewith, even a tensile stress can be applied to a portion undergoing bending. As a result, the range of possible bending can be widened, and the working accuracy of a bent product is increased.

The movable roller die in the present invention preferably has two rolls, three rolls, or four or more rolls. The metal material is not limited to a particular cross-sectional shape, and it can have any cross-sectional shape as long as each portion constituting a cross section can be heated by the heating means to a temperature at which bending is possible. For example, it is preferably a hollow member having a closed cross-sectional shape, a member having an open cross-sectional shape, or a hollow member having a profile cross-sectional shape such as a channel. The type of rolls used in the movable roller die can be suitably selected in accordance with the cross-sectional shape of the metal material being worked.

In the present invention, the metal material is preferably heated a plurality of times by at least one preheating means provided upstream of the heating means, or else nonuniform heating is preferably carried out such that the degree of heating is not constant in the circumferential direction around the axis of the metal material.

When preheating is performed for the purpose of multistage heating, the heating load on the metal material can be dispersed, and the efficiency of bending can be increased. On the other hand, when using a preheating means for nonuniform heating of a metal material, heating is preferably controlled based on the bending direction of the metal material by the movable roller die, for example, so that the temperature on the inner side of the portion being bent in the heated portion of the metal material is lower than the temperature on the outer side of the portion being bent. By carrying out nonuniform heating of a metal material in this manner, wrinkles which develop on the inner side of a portion being bent and cracks which develop on the outer side of a portion being bent can both be prevented.

In the present invention, a mandrel is preferably inserted into the metal material as a cooling means and a cooling medium is supplied. This is particularly effective for maintaining the cooling rate when the metal material is a thick-walled material.

In the present invention, a cooling medium which is supplied from the cooling means preferably is water-based and contains a rust-preventing agent and/or a quenching agent. If a sliding part is wet by cooling water supplied from the cooling device, rust develops when the cooling water does not contain a rust-preventing agent. Therefore, the cooling water preferably contains a rust-preventing agent. The cooling medium which is supplied from the cooling means may be of water-based medium containing a quenching agent. By way of example, a quenching agent incorporating an organic polymer is known. By employing a cooling medium containing an appropriate concentration of a quenching agent, it is possible to control the cooling rate and maintain stable quenching.

In the present invention, it is preferable to supply a lubricant and/or a cooling fluid to the movable roller die. When a lubricant is supplied to the movable roller die, even when scale which develops on the heated portion of the metal material becomes wrapped around the movable roller die, the occurrence of seizing on the surface of the die can be decreased by the lubricating action. In addition, when a cooling fluid is supplied to the movable roller die, the movable roller die is cooled by the cooling fluid, so a decrease in the strength of the movable roller die, a decrease in the accuracy of working due to thermal expansion of the movable roller die, and the occurrence of seizing of the surface of the movable roller die can be prevented.

In addition, in the present invention, operation of the movable roller die, the heating means, or the cooling means by at least one of a shifting mechanism, a tilting mechanism, and a moving mechanism is preferably carried out by an articulated robot which supports the movable roller die, the heating means, or the cooling means and which has a joint which can rotate about at least one axis.

When using an articulated robot and particularly an articulated robot which holds the movable roller die, the positioning accuracy of the movable roller die can be improved by using not one robot but by using two or more robots in combination to support the movable roller die and synchronizing the articulated robots so as to move the movable roller die two-dimensionally or three-dimensionally.

By using an articulated robot, when performing bending of a metal pipe, shifting operation upwards and downwards or to the left and right, tilting operation which tilts up and down or to the left and right, moving operation in the forwards and backwards direction, or twisting operation of the metal pipe which are carried out by manipulators and which are required by the movable roller die, the heating means, and the cooling means can be easily carried out by a series of operations based on a control signal. Therefore, bending can be made more efficient, and a decrease in the size of a working apparatus can be achieved.

In the present invention, a synchronizing means is preferably provided to synchronize the support guide, which supports a portion of the metal material which has passed through the movable roller die, with the movement of the movable roller die.

From another standpoint, the present invention is a continuous manufacturing line for a bent product characterized by comprising an uncoiler which continuously pays off a steel strip, a forming means which forms the uncoiled steel strip into a pipe having a predetermined cross-sectional shape, a welding means which welds the abutting side edges of the steel strip to form a continuous pipe, a post-treatment means which cuts the weld bead and if necessary performs post-annealing and sizing, the uncoiler, the forming means, the welding means, and the post-treatment means constituting a manufacturing line for seam welded pipe, and a manufacturing apparatus for a bent product according to the present invention as described above disposed on the exit side of the post-treatment means.

The present invention is also a continuous manufacturing line for a bent product characterized by comprising an uncoiler which continuously pays off a steel strip and a forming means which forms the uncoiled steel strip into a predetermined cross-sectional shape, the uncoiler and the forming means constituting a roll forming line, and a manufacturing apparatus for a bent product according to the present invention which is disposed on the exit side of the forming means.

Effects of the Invention

According to the present invention, even when manufacturing a bent product which requires bending into a various shapes in which the bending direction of a metal material varies two-dimensionally such as with S-bending or three-dimensionally, and even when bending a metal material of high strength is necessary, a bent product having a desired hardness distribution, a desired dimensional accuracy, and a high strength and good shape retention can be efficiently and inexpensively manufactured.

Moreover, as the movable roller die supports the metal material so as to be able to rotate, the formation of seizing scratches on the surface of the die can be suppressed, the accuracy of bending can be guaranteed, and bending can be performed with excellent operating efficiency. As a result, the present invention can be widely employed as a bending technique for bent products having a high strength, such as bent products for automobiles.

EXPLANATION OF SYMBOLS

1 metal material; 2 support means; 3 feed device; 4 movable roller die, pinch rolls; 5 heating means, heating device, high-frequency heating coil; 5*a* preheating means, preheating device, high-frequency heating coil for preheating; 6 cooling means, cooling device; 6*a* mandrel; 7 chuck mechanism; 8, 9, 10 drive motors; 10*a* drive gear; 11 articulated robot; 12 stationary surface; 13, 14, 15 arms; 16, 17, 18 joints; 19 seam welded steel pipe manufacturing line; 20 steel strip; 21 uncoiler; 22, 27 forming means; 23 welding means; 24 post-treatment means; 25, 28 cutting means; 26 roll forming line; 30 support guide

BEST MODE FOR CARRYING OUT THE INVENTION

Below, a best mode for carrying out a method of manufacturing a bent product, a manufacturing apparatus, and a continuous manufacturing line according to the present invention will be explained in detail while referring to the attached drawings.

The (I) overall structure and the support means, (II) the structure of a working portion and heating and cooling devices, (III) a movable roller die, (IV) a preheating device and its effect, (V) a support guide, (VI) the structure and arrangement of an articulated robot, and (VII) a bending line will be explained below in the above order while referring to the attached drawings.

(I) Overall Structure and Support Means

Figure 1:
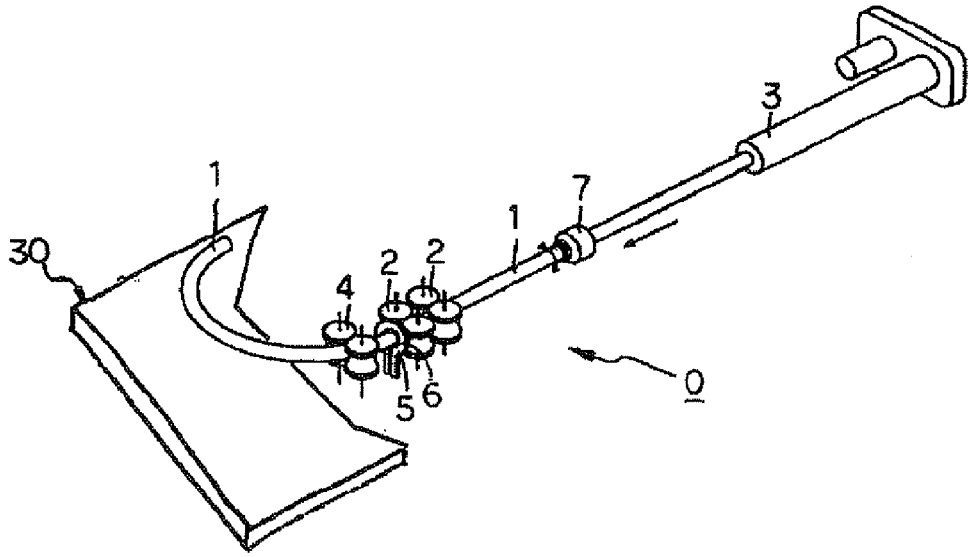
FIG. 1 is an explanatory view showing in simplified form the overall structure of a manufacturing apparatus for a bent product which carries out bending according to an embodiment of the present invention.

FIG. 1 is an explanatory view showing in simplified form the overall structure of a manufacturing apparatus 0 for a bent product for carrying out bending according to an embodiment of the present invention.

Bending in this embodiment is carried out by performing bending on the downstream side of support means 2,2 while intermittently or continuously feeding a metal material 1 with a feed device 3 from the upstream side. The metal material 1, which is a material being worked, is supported by the support means 2,2 so as to be able to move in the axial direction.

The metal material 1 shown in FIG. 1 is a steel pipe having a round transverse cross-sectional shape, but it is not limited to a steel pipe, and any elongated material to be worked having any type of transverse cross-sectional shape can be similarly employed. In addition to the steel pipe shown in FIG. 1, the metal material 1 can be a member with a closed cross section having a rectangular, trapezoidal, or complicated transverse cross-sectional shape, a member with an open cross section manufactured by roll forming or the like such as a channel, or a member with a profile cross section such as a channel which is manufactured by feed processing.

Figure 2:
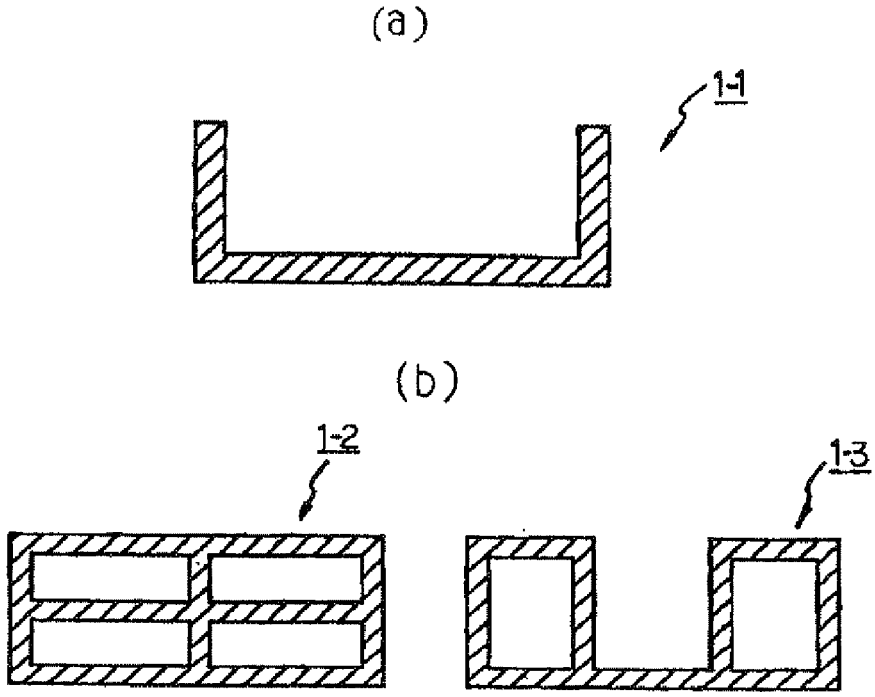
FIG. 2 is an explanatory view showing the transverse cross-sectional shape of a material being worked which can be employed as a metal material in an embodiment, FIG. 2(*a*) showing a channel having an open cross section formed by roll forming or the like, and FIG. 2(*b*) showing a channel having a profile cross section manufactured by feed processing.

FIG. 2 is an explanatory view showing the transverse cross-sectional shape of members being worked 1-1 to 1-3 which can be used as a metal material 1 in this embodiment. FIG. 2(*a*) shows a channel 1-1 having an open cross section which is manufactured by roll forming or the like, and FIG. 2(*b*) shows channels 1-2 and 1-3 having profile cross sections which are manufactured by feed processing. In the manufacturing apparatus 0 of this embodiment, the shape of the contact portion with the metal material 1 in the below-described movable roller die 4 and support means 2 can be suitably selected in accordance with the transverse cross-sectional shape of the metal material 1 which is employed.

The manufacturing apparatus 0 shown in FIG. 1 has two sets of support means 2,2 spaced from each other in the direction of movement of the metal material 1 for supporting the metal material 1 in a predetermined position so as to be able to move in the axial direction, and a feed device 3 disposed on the upstream side of the support means 2,2 for intermittently or continuously feeding the metal material 1. The manufacturing apparatus 0 has a movable roller die 4 which is disposed on the downstream side of the two sets of support means 2,2 and which supports the metal material 1 so that the metal material can move in its axial direction. The installation position of the movable roller die 4 can be varied two-dimensionally or three-dimensionally.

On the entrance side of the movable roller die 4 are provided a high-frequency heating coil 5 which is a heating means for locally rapidly heating a portion of the metal material 1 in its lengthwise direction and which is disposed on the outer periphery of the metal material 1, and a cooling device 6 which is a cooling means for rapidly cooling the portion of the metal material 1 which was rapidly locally heated by the high-frequency heating coil 5 and which is the portion to which a bending moment is imparted by two-dimensional or three-dimensional movement of the movable roller die 4.

In addition, a support guide 30 for suppressing deformation of the metal material 1 after bending by supporting a portion of the metal material which has passed through the movable roller die 4 is disposed on the exit side of the movable roller die 4.

In the embodiment shown in FIG. 1, since a steel pipe having a round transverse cross-sectional shape is used as a metal pipe 1, a pair of grooved rolls opposing and spaced from each other so that their rotational axis are parallel is used as each support means 2. However, the support means 2 is not limited to a pair of grooved rolls, and a suitable support guide matching the transverse cross-sectional shape of the metal material 1 can be used as a support means. Even when a support means is constituted by a pair of grooved rolls, the structure is not limited to the two sets of support roll pairs 2,2 shown in FIG. 1, and the support means may be constituted by one set or three or more sets of support roll pairs 2.

Figure 3:
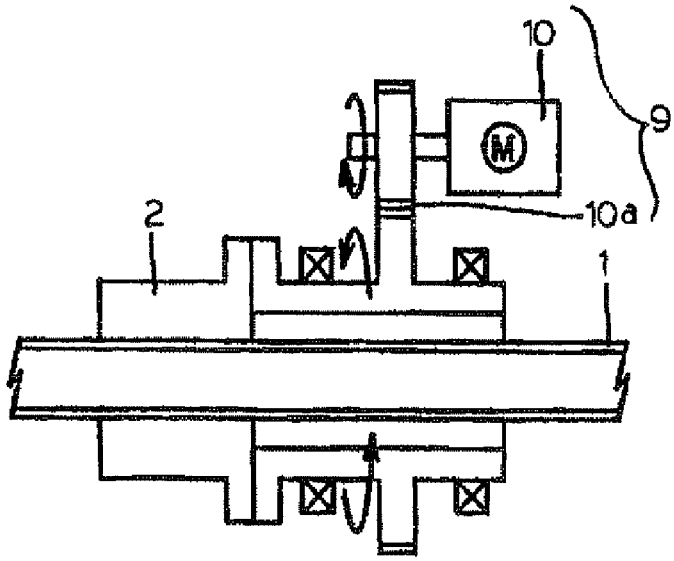
FIG. 3 is an explanatory view showing one example of the structure of a support guide which can be used as a support means in an embodiment, FIG. 3(*a*) being a cross-sectional view showing the arrangement of a support guide and a rotating mechanism which drives the support guide, and FIG. 3(*b*) being a perspective view showing the external appearance of the support guide.
Figure 3:
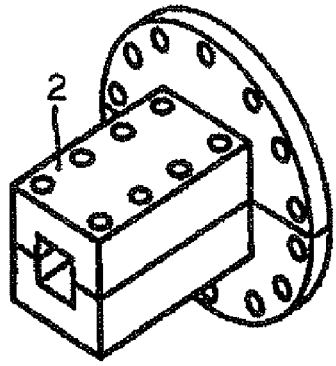

FIG. 3 is an explanatory view showing one example of the structure of a support guide which can be used as a support means 2 in this embodiment. FIG. 3(*a*) is a cross-sectional view showing the arrangement of a support guide 2 and a rotating mechanism 9 which drives support guide 2, and FIG. 3(*b*) is a perspective view showing the external appearance of the support guide 2.

This example shows the case in which the transverse cross-sectional shape of the metal material 1 is a rectangular pipe, and the support guide 2 holds the rectangular pipe 1 so that it can rotate. As the support guide 2 is disposed in the vicinity of the high-frequency heating coil 5, it is preferably made of a non-magnetic material in order to prevent the support guide from being heated. In addition, as shown in FIG. 3(*b*), it is preferably divided into two or more parts, and an unillustrated electrically insulating material such as Teflon (trademark) is preferably mounted between the divided portions.

The rotating mechanism 9, which is directly connected to the support guide 2, is constituted by a drive motor 10 and a rotating gear 10*a*. As described below, the support guide 2 can be rotated in the circumferential direction around the axis of the metal material 1 in synchrony with the rotation of the feed device 3. Highly accurate twisting deformation can thereby be imparted to the metal material 1 when twisting deformation of the metal material 1 is desired.

The manufacturing apparatus 0 can use either the support rolls shown in FIG. 1 or the support guide shown in FIG. 3 as a support means 2 for the metal material 1. For consistency, the following explanation will primarily describe to an embodiment in which the steel pipe 1 shown in FIG. 1 is used as a metal material and support rolls 2 are used and the effects of that embodiment. However, in the present invention, the same effects are obtained not only when a metal material is a round pipe but when it has a different closed cross-sectional shape, an open cross-sectional shape, or a profile cross-sectional shape, or when a support guide is used in place of support rolls.

Figure 4:
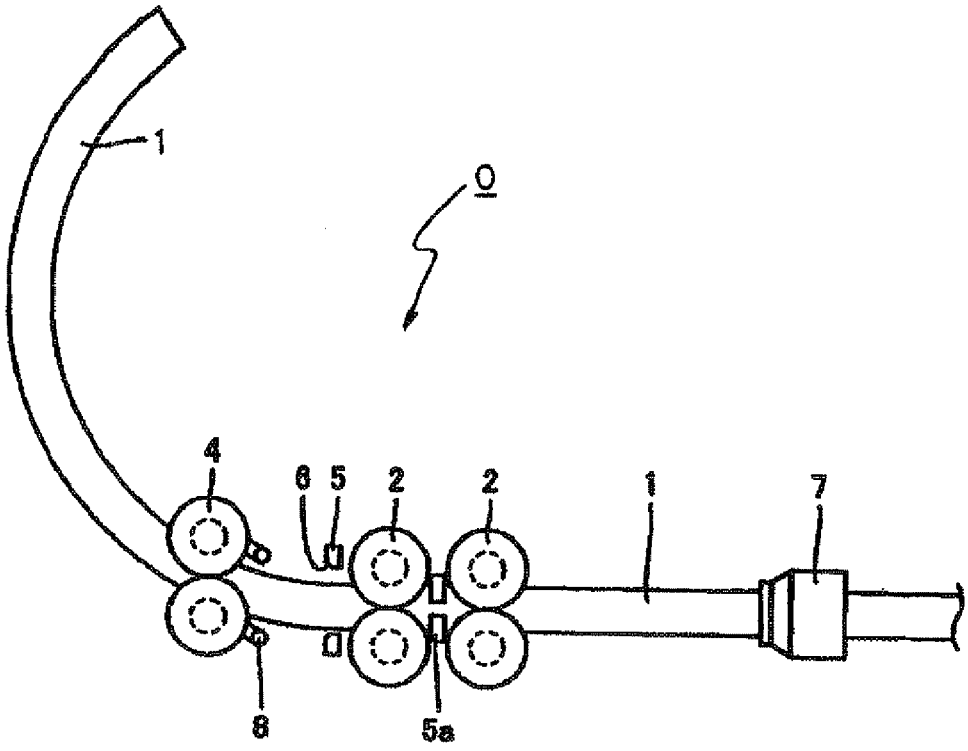
FIG. 4 is an explanatory view showing the structure of the working portion of an embodiment of a manufacturing apparatus.

(II) Structure of the Working Portion, the Heating Device, and the Cooling Device FIG. 4 is an explanatory view showing the structure of a working portion of a manufacturing apparatus 0 of this embodiment.

As shown in this figure, two sets of support roll pairs 2,2 which hold a metal material 1 are provided, and a movable roller die 4 is disposed on the downstream side thereof. A high-frequency heating coil 5 and a cooling device 6 which are integrated with each other are disposed on the entrance side of the movable roller die 4. In addition, a preheating device 5*a* is disposed between the two sets of support roll pairs 2,2, and a supply device 8 for a lubricant is disposed on the entrance side of the movable roller die 4 in the immediate vicinity thereof.

In FIG. 4, a metal material 1 which has passed through the two sets of support roller pairs 2, 2 is supported by the movable roller die 4 so as to be able to move in its lengthwise direction. The metal material 1 is bent into a predetermined shape by locally heating it with the high-frequency heating coil 5 disposed on the outer periphery of the metal material 1 to a temperature at which quenching is possible while controlling the position of the movable roller die 4 and if necessary its speed of movement two-dimensionally or three-dimensionally. In addition, the a portion of the metal material underwent bending is rapidly cooled locally by the cooling device 6.

When carrying out bending, a metal material 1 which has passed through the two sets of support roll pairs 2,2 is heated by the high-frequency heating coil 5 to a temperature range in which quenching is possible. As a result, the yield point of the portion of the metal material 1 which is bent by the movable roller die 4 is decreased leading to a decrease in the resistance to deformation, so the metal material 1 can be easily bent to a desired shape.

In addition, as the metal material 1 is supported for movement in the axial direction by pairs of grooved rolls 2,2, the occurrence of seizing scratches in the surface of the movable roller die 4 can be suppressed. Moreover, a lubricant is supplied to the movable roller die 4, so even when scale which develops on the heated portion of the metal material 1 become caught on the movable roller die 4, the occurrence of seizing scratches on the surface of the movable roller die 4 is reduced by the lubricating action.

In this manufacturing apparatus 0, a cooling fluid can be supplied to the movable roller die 4 so that the movable roller die 4 is cooled by the cooling fluid. As a result, a decrease in the strength of the movable roller die 4, a decrease in working accuracy due to thermal expansion of the movable roller die 4, and the occurrence of seizing scratches on the surface of the movable roller die 4 can all be prevented.

Figure 5:
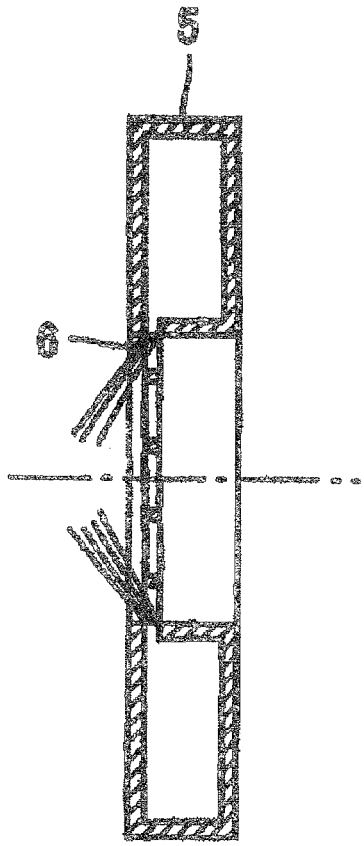
FIG. 5 is an explanatory view schematically showing an example of the structure of a heating device and a cooling device in an embodiment of a manufacturing apparatus.

FIG. 5 is an explanatory view schematically showing an example of the structure of the heating device 5 and the cooling device 6 in this embodiment.

The heating device 5 is constituted by a high-frequency heating coil 5 which is arranged in an annular shape on the outer periphery of a portion of a metal material 1 which is to be heated. The heating coil locally heats the metal material 1 to a temperature range in which quenching is possible. A bending moment is then applied to the portion of the metal material 1 which was heated by the heating device 5 by moving the movable roller die 4 two-dimensionally or three-dimensionally.

The distance of the heating device 5 from the metal material 1 in a direction parallel to a direction perpendicular to the axial direction of the metal material 1 can preferably be varied so that a portion of the metal material 1 being fed can be non-uniformly heated in its circumferential direction.

The metal material 1 is quenched by spraying a cooling medium from the cooling device 6 at the heated portion of the metal material 1.

As described above, the metal material 1 prior to high-frequency heating is supported by the two sets of support roll pairs 2,2. In this embodiment, the heating device 5 and the cooling device 6 are integral with each other, but they may be formed separately from each other.

As shown in the figure, the cooling medium is preferably sprayed in a direction sloped with respect to the direction in which the metal material 1 is being fed, and the distance of the cooling device 6 from the metal material in a direction parallel to a direction perpendicular to the axial direction of the metal material 1 can preferably be varied. As a result, the region in the axial direction of the metal material 1 which is quenched by the cooling device 6 can be adjusted. In particular, the heated region on the inner and outer sides of a bent portion can be suitably adjusted.

In this manner, a metal material 1 can be intermittently or continuously heated to a temperature which is at least the $A_3$ transformation point and at which the structure does not coarsen, plastic deformation can be imparted to the a portion of the metal material was locally heated by the movable roller die 4, and immediately thereafter, a cooling medium is sprayed at the heated portion, whereby quenching can be performed at a cooling rate of at least 100° C. per second.

Accordingly, the metal material 1 which is subjected to bending can achieve excellent shape retention and stable quality. For example, even when bending is carried out using a low strength metal material as a starting material, the strength of the material can be increased by carrying out uniform quenching in the axial direction, and a bent product having a tensile strength corresponding to at least 900 MPa or even 1300 MPa class or above can be manufactured.

As the wall thickness of the metal material 1 increases, it sometimes becomes difficult to maintain a cooling rate of at least 100° C. per second. In such cases, when the metal material 1 is a hollow member with a closed cross section (a metal pipe) such as a round pipe, a rectangular pipe, or a trapezoidal pipe, a mandrel bar is preferably inserted into the member with a closed cross section as a cooling means for guaranteeing a desired cooling rate.

Figure 6:
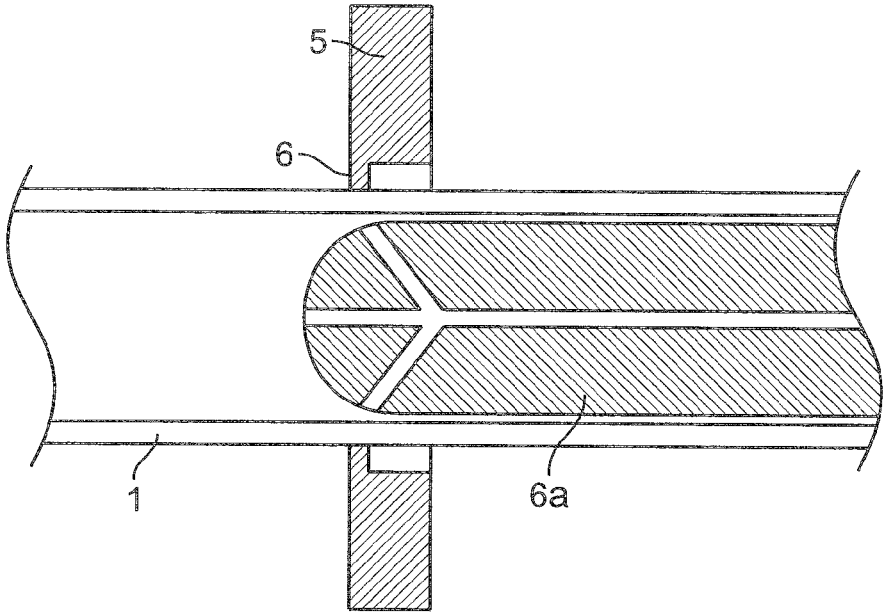
FIG. 6 is an explanatory view showing the state in which a mandrel is inserted into the interior of a hollow member with a closed cross section in order to guarantee the cooling rate of a thick-walled member.

FIG. 6 is an explanatory view showing the state in which a mandrel bar is inserted into a hollow member with a closed cross section in order to guarantee the cooling rate of a thick-walled material.

When a hollow member with a closed cross section has a large wall thickness, a mandrel bar 6*a* can be inserted into its interior as a cooling means, and a cooling medium can be supplied in synchrony with the cooling means 6 disposed on the outer periphery of the metal material 1 to guarantee the desired cooling rate. The interior of the metal material 1 can be cooled with a fluid or a mist. The mandrel bar 6*a* is preferably made of a non-magnetic material or a refractory material.

The manufacturing apparatus 0 of this embodiment preferably uses a water-based cooling medium containing a rust-preventing agent as the cooling medium which is supplied by the cooling means 6. If sliding parts of the working apparatus are wet by cooling water which does not contain a rust-preventing agent, rust develops. Therefore, it is effective to include a rust-preventing agent in the cooling water.

In addition, a cooling medium supplied from the cooling means 6 is preferably a water-based one containing a quenching agent. For example, a quenching agent containing an organic polymer is known. By adding a quenching agent in an appropriate prescribed concentration, the cooling rate can be adjusted and stable hardenability can be guaranteed.

(III) Structure of the Movable Roller Die 4

Figure 7:
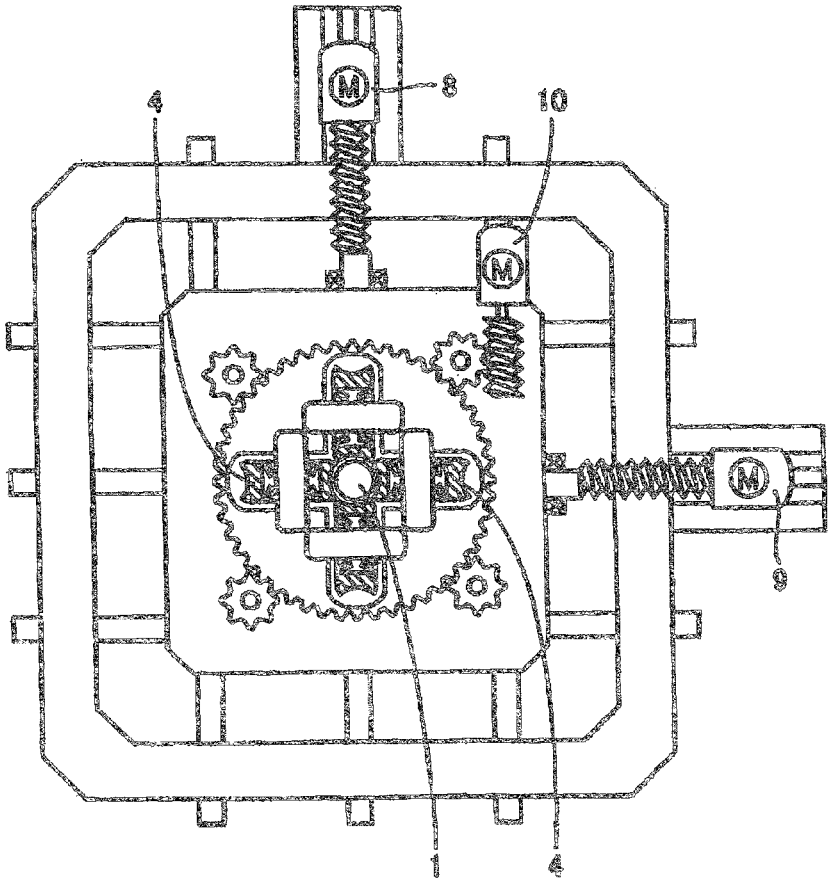
FIG. 7 is an explanatory view showing a shifting mechanism for shifting a movable roller die up and down and to the left and right, and a rotating mechanism for rotating it in the circumferential direction in a manufacturing apparatus of an embodiment.

FIG. 7 is an explanatory view showing shifting mechanisms for moving the movable roller die 4 in the manufacturing apparatus 0 of this embodiment up and down and to the left and right and a rotating mechanism for rotation in the circumferential direction around the axis of a metal pipe.

The movable roller die 4 shown in FIG. 7 is different from the movable roller die 4 shown in FIG. 1 and has four rolls which support a metal material 1 (a round pipe) which is a material being worked so that the material can move in its axial direction. A shifting mechanism for shifting upwards and downwards is constituted by a drive motor 8, and a shifting mechanism for movement to the left and right is constituted by a drive motor 9. A rotating mechanism for rotation in the circumferential direction is constituted by a drive motor 10.

In FIG. 7, the structure of a tilting mechanism which tilts the movable roller die 4 up and down or to the left and right is not shown. However, there is no particular limitation on this tilting mechanism, and a well-known, conventional mechanism can be employed.

Figure 8:
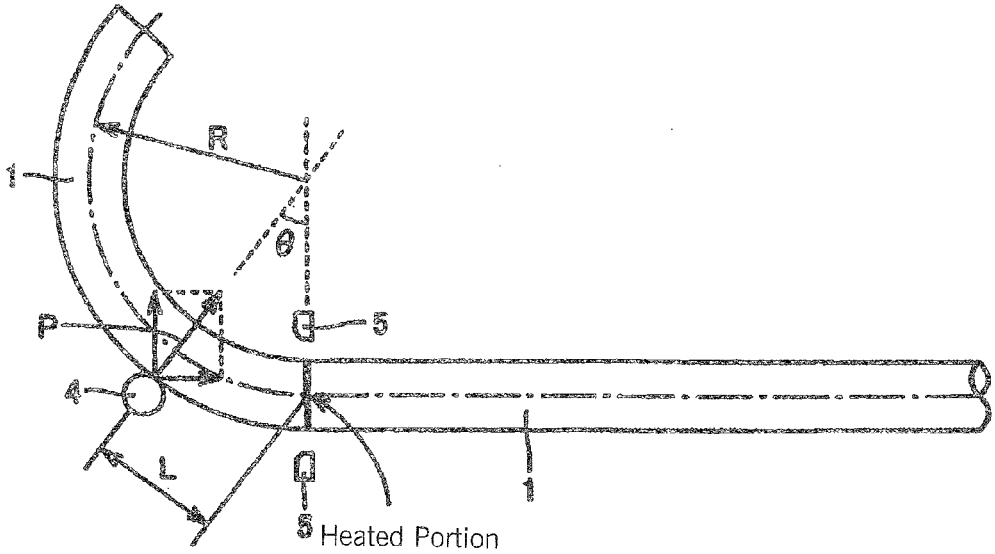
FIG. 8 is an explanatory view of a moving mechanism for moving a movable roller die back and forth in a manufacturing apparatus of an embodiment.

FIG. 8 is an explanatory view of a moving mechanism for movement in the forwards and backwards direction of the movable roller die 4. As shown in FIG. 8, the bending moment M necessary for bending is determined by the following equation (A) in which L is the arm length (the work length of the metal material 1).

$$M=P\times L=P\times R\sin\theta \quad \text{(A)}$$

Accordingly, the longer is the arm length L, the smaller is the force P acting on the pinch rolls (the movable roller die) 4. Namely, when it is desired to perform working which ranges from a small radius of curvature to a large radius of curvature, if the movable roller die 4 is not moved forwards and backwards, the force P when working is performed on a metal material 1 having a small radius of curvature sometimes exceeds the capacity of the equipment. Therefore, if the arm length L is set to a large value when working a metal material 1 having a small radius of curvature, when working is performed on a metal material having a large radius of curvature, a large stroke is necessary for the shifting mechanism and the tilting mechanism of the movable roller die 4, and the apparatus becomes large.

On the other hand, taking into consideration the stopping accuracy and the allowable error of the manufacturing apparatus 0, the working accuracy worsens when the arm length L is small. Therefore, by arranging the movable roller die 4 so that it can move forwards and backwards in accordance with the bending radius of the metal material 1, an optimal arm length L is obtained regardless of the radius of curvature of the metal material 1, and the range in which working is possible can be increased. Moreover, a sufficient working accuracy can be guaranteed without increasing the size of the working apparatus.

Similarly, in the manufacturing apparatus 0 of this embodiment, a moving mechanism for back and forth movement may be provided individually or in common for the high-frequency heating device and the cooling device. As a result, synchronization of these devices with the movable roller die 4 can be maintained, the end of a metal material 1 can be heated at the start of bending, and the ease of mounting and dismounting of the metal material 1 and operability can both be improved.

Figure 9:
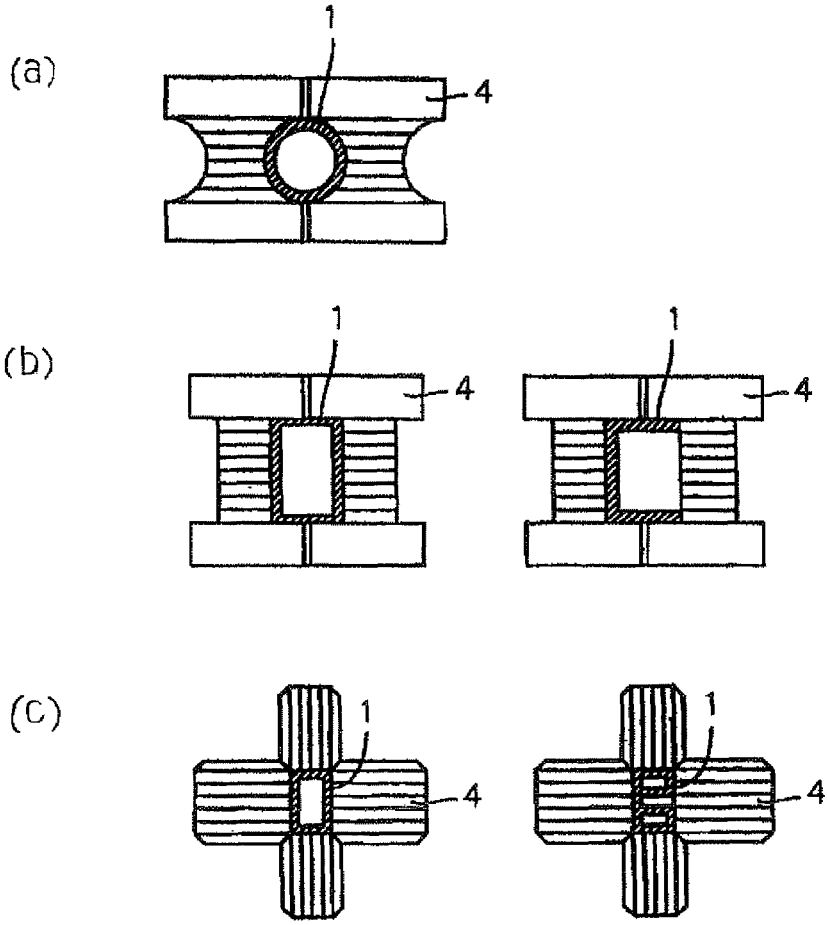
FIG. 9 shows rolls which constitute a movable roller die of a manufacturing apparatus of an embodiment, FIG. 9(*a*) showing a case in which a metal material is a hollow member with a closed cross section, FIG. 9(*b*) showing a case in which a metal material is a member with a closed cross section such as a rectangular pipe or a member with an open cross section such as a channel, and FIG. 9(*c*) showing a case in which a metal material is a member with a closed cross section such as a rectangular pipe or a member with a profile cross section such as a channel.

FIG. 9 is an explanatory view showing various rolls of a movable roller die 4 of the manufacturing apparatus 0 in this embodiment. FIG. 9(*a*) shows a case in which a metal material 1 is a member with a closed cross section such as a round pipe, FIG. 9(*b*) shows a case in which a metal material 1 is a member with a closed cross section such as a rectangular pipe or a member with an open cross section such as a channel, and FIG. 9(*c*) shows a case in which a metal material 1 is a member with a closed cross section such as a rectangular pipe or a member with a profile cross section such as a channel.

The shape of rolls in the movable roller die 4 can be designed in accordance with the cross-sectional shape of the metal material 1. While the movable roller die 4 may be constituted by two or four rolls as shown by FIGS. 9(*a*)-9(*c*), it may also be constituted by three rolls.

Normally, the cross sectional shape of a metal material which undergoes bending can be a closed cross-sectional shape such as a round, rectangular, or trapezoidal shape, or complex shape which is formed by roll forming, or an open cross-sectional shape or it may be a profile cross-sectional shape obtained by feed processing. When the cross-sectional shape of the metal material 1 is substantially rectangular, as shown in FIG. 9(*c*), the movable roller die 4 preferably has four rolls.

In the manufacturing apparatus 0 of this embodiment, in order to additionally impart twisting deformation to the metal material 1, as shown in FIG. 7, the movable roller die 4 is preferably provided with a rotating mechanism for rotation in the circumferential direction around the axis of the metal material 1. In addition, although not shown in FIG. 1, the feed device 3 is preferably provided with a chuck mechanism 7 which can grip the metal material 1 and rotate it in the circumferential direction about its axis.

Accordingly, when additionally imparting twisting deformation to the metal material 1 with the manufacturing apparatus 0, it is possible to use a method in which twisting deformation is imparted to the front end of the metal material 1 using a rotating mechanism of the movable roller die 4 or a method in which twisting deformation is imparted to the rear end of the metal material 1 using a rotating mechanism of the feed device 3. Normally, a method using a rotating mechanism of the feed device 3 results in a compact apparatus, while a method using a rotating mechanism of the movable roller die 4 may cause the apparatus to become large. However, either method can impart twisting deformation to a metal material 1.

In the manufacturing apparatus 0, by further providing the support means 2 (support rollers or support guide) with a rotating mechanism which rotates in the circumferential direction about the axis of the metal material 1, it is possible to rotate the metal material 1 in the circumferential direction about its axis in synchrony with the rotation of the feed device 3. When imparting twisting deformation to the metal material 1, it is possible to impart twisting deformation to the metal material 1 with good accuracy as a result of synchrony with the support means 2 whether using a method in which twisting deformation is imparted to the front end of the metal material 1 using a rotating mechanism of the movable roller die 4 or a method in which twisting deformation is imparted to the rear end of the metal material 1 using a rotating mechanism of the feed device 3.

In the manufacturing apparatus 0, by providing each roll pair constituting the movable roller die 4 with a rotational drive mechanism, a rotational drive force can be imparted to the roll pair by drive motors or the like in accordance with the amount of feed by the feed device 3. As a result, the compressive stresses acting on the portion undergoing bending can be relaxed, and if the rotational speed of the rolls of the movable roller die 4 is controlled so as to be synchronous with the feed by the feed device 3 in accordance with the amount of feed by the feed device, it is possible to impart a tensile stress to the portion of the metal material 1 undergoing bending. Thus, the size of the region undergoing bending can be increased, and the working accuracy of a product can be increased.

(IV) Preheating Means and its Effect

In a manufacturing apparatus 0 of this embodiment, two or more stages of heating or non-uniform heating of the metal material 1 can be carried out by the preheating device 5*a* provided on the upstream side of the heating device 5.

When the preheating means 5*a* is used for multistage heating, the heating load on the metal material 1 can be dispersed, and the efficiency of bending can be increased.

Figure 10:
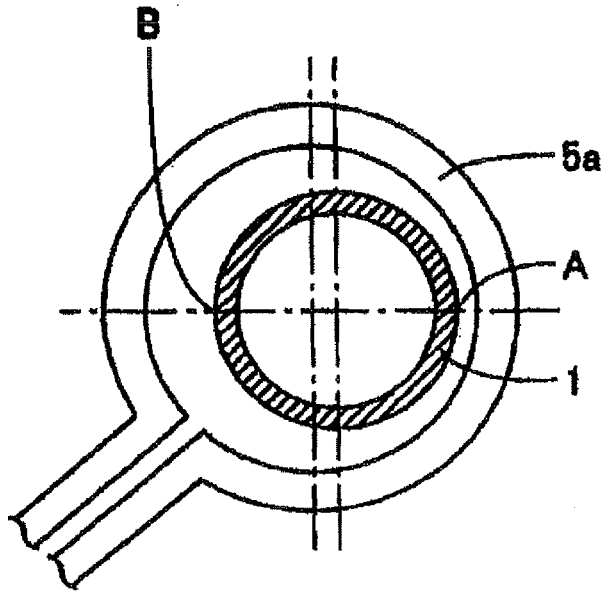
FIG. 10 is a view for explaining the effects when a preheating device is used for non-uniform heating of a metal material.

FIG. 10 is an explanatory view for explaining the effect when the preheating device 5*a* is used for non-uniform heating of the metal material 1.

When a high-frequency heating coil 5*a* for preheating is used as a preheating device for carrying out non-uniform heating of the metal material 1, by disposing the metal material 1 towards one side of the interior of the high-frequency coil 5*a* for preheating, based on the bending direction of the metal material 1 by the movable roller die 4, the temperature of the heated portion of the metal material 1 on the inner side of a bend is made lower than the temperature on the outer side of a bend.

Specifically, in FIG. 10, by positioning side A of the metal material 1 so as to be close to the high-frequency heating coil 5*a* for preheating, the temperature of the outer surface on side A corresponding to the outer side of a bend is made higher than the temperature of the outer surface on side B corresponding to the inner side of a bend. As a result, wrinkles which develop on the inner side of a bend and cracks which develop on the outer side of a bend can both be effectively prevented.

A lubricant can be supplied to the movable roller die 4 in the manufacturing apparatus 0. As a result, when scale which develops on the heated portion of the metal material 1 becomes caught on the movable roller die 4, the occurrence of seizing on the surface can be decreased by the lubricating action provided by the supplied lubricant.

Similarly, a cooling fluid can be supplied to the movable roller die 4 in the manufacturing apparatus 0. By providing cooling piping in the interior of the movable roller die 4 in the vicinity of the location which holds a metal material 1 and supplying a cooling fluid to the movable roller die 4, the movable roller die 4 is cooled by the cooling fluid. Thus, a decrease in the strength of the movable roller die 4, a decrease in working accuracy due to thermal expansion of the movable roller die 4, and the occurrence of seizing on the surface of the movable roller die 4 can be prevented.

(V) Support Guide 30

Figure 11:
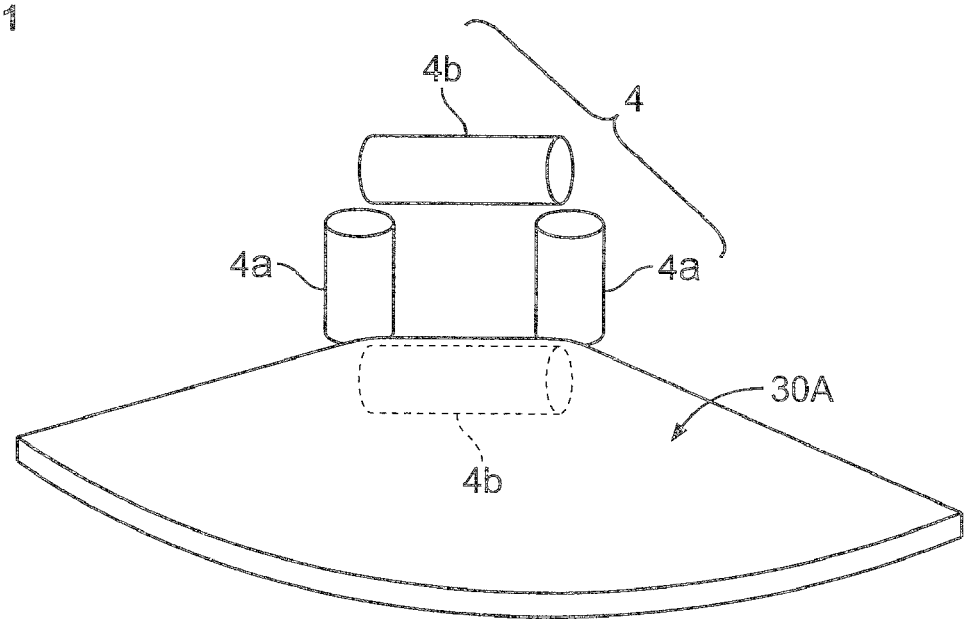
FIG. 11 is an explanatory view showing one example of a support guide.

FIG. 11 is an explanatory view showing one example 30A of a support guide 30. The support guide 30 is for the purpose of suppressing errors in a metal material 1 undergoing bending by supporting the metal material 1 which has passed through the movable roller die 4.

The support guide 30A shown in FIG. 11 is being used when carrying out bending on a metal material having a rectangular transverse cross section instead of the metal material 1 shown in FIG. 1 having a round transverse cross section. In the illustrated case, the movable roller die 4 is constituted by a total of 4 rolls including a vertical roll pair 4*a*, 4*a* on the left and the right and a horizontal pair 4*b*, 4*b* above and below. In this case, a portion of a metal material 1 undergoing bending has a two-dimensionally bent shape which changes in shape only in a horizontal plane.

At the time of bending, the movable roller die 4 moves to a prescribed spatial position with performing positioning of the end of the metal material 1 in the vertical direction by the horizontal roll pair 4*b*, 4*b* and to the left and right by the vertical roll pair 4*a*, 4*a*. Namely, movement of the roller die in the horizontal direction (referred to below as horizontal shifting) and rotation thereof in a plane (referred to below as left and right tilting) are carried out. When the metal material 1 has only a two-dimensionally bent shape, it is possible to carry out only horizontal shifting.

As shown in FIG. 11, the support guide 30A is installed on the exit side of the movable roller die 4. The support guide 30A may be disposed in an unillustrated housing of the movable roller die 4 or in another member unconnected to the housing.

By supporting the lower surface of the metal material 1 which underwent bending on the exit side of the movable roller die 4, the support guide 30A prevents the metal material from undergoing additional deformation caused by a moment in the vertical direction due to gravity acting on the portion of the metal material 1 which underwent bending. Therefore, by providing the support guide 30A, a bent product can be stably manufactured to a desired shape with high accuracy.

Figure 12:
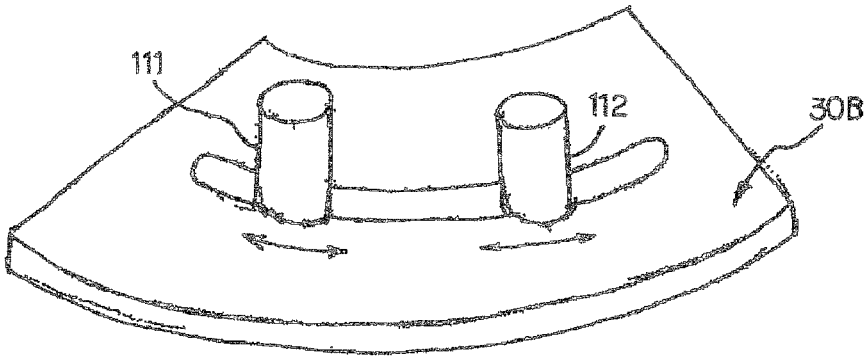
FIG. 12 is an explanatory view showing another example of a support guide.

FIG. 12 is an explanatory view showing another example 30B of a support guide 30 according to this embodiment.

This example is also for use when carrying out bending on a metal material having a rectangular transverse cross section, and an unillustrated movable roller die is a four-roll type like the movable roller die 4 shown in FIG. 4. The metal material 1 has a two-dimensionally bent shape with bending deformation only in a horizontal plane. At the time of bending, the movable roller die 4 moves while holding and positioning the end of the metal material 1 in the vertical direction and to the left and right so that the roller die moves to a prescribed spatial position, namely, by horizontal shifting and left and right tilting.

In this example, in the same manner as in the example shown in FIG. 11, a support guide 30B is disposed on the exit side of the movable roller die 4, but in addition rolls 111 and 112 which guide the metal material 1 in the horizontal direction are disposed in a groove provided in the top surface of the support guide 30B such that these rolls can move along a circular path and. The rolls 111 and 112 move in accordance with the movement of the metal material 1 at the time of working, i.e., they carry out horizontal shifting and left and right tilting. These movements are transmitted to an unillustrated control means so as to synchronize with the feed device 3 and the movable roller die 4.

With the support guide 30B shown in FIG. 12, left and right tilting is carried out with a prescribed radius. However, with a two-dimensionally bent shape, it is possible to carry out only horizontal shifting. In addition, a pressure applying means such as a hydraulic cylinder may be provided on one of rolls 111 and 112.

The support guide 30B can be installed in a housing of the movable roller die 4 or in another member which is separate from the housing. If the movable roller die 4 is secured in a housing, the range of movement in horizontal shifting or left and right tilting is decreased, which is advantageous from the standpoint of installation. In either case, since the lower surface and the left and right surfaces of a metal material 1 during bending are guided on the exit side of the movable roller die 4 by the support guide 30B, additional deformation of the metal material 1 can be prevented even if the hot worked portion undergoes the action of gravity of the metal material or of an additional moment in the vertical direction or to the left and right due to nonuniform thermal deformation caused by nonuniform heating and cooling, and a bent product having a prescribed target shape without variations can be manufactured.

Figure 13:
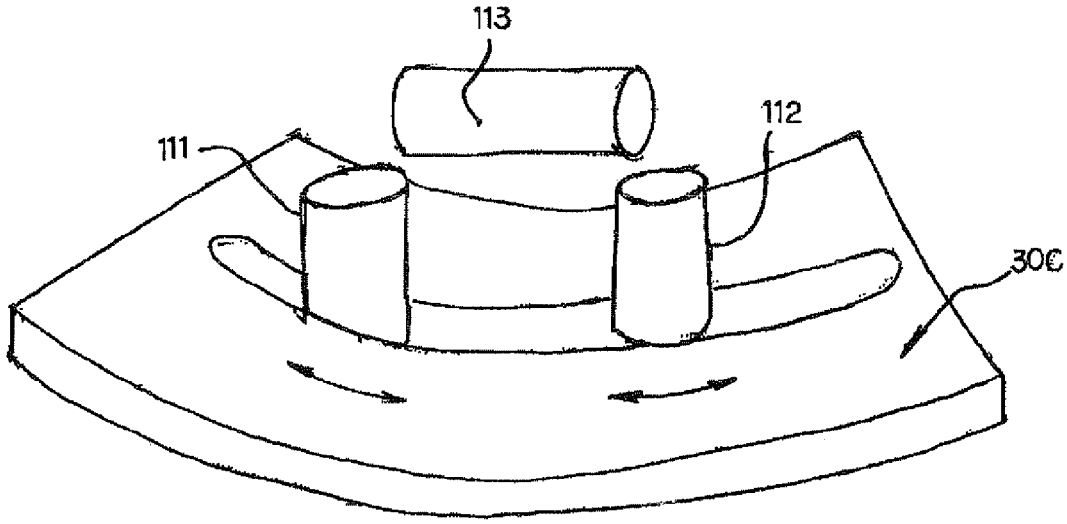
FIG. 13 is an explanatory view showing another example of a support guide.

FIG. 13 is an explanatory view showing another example of a support guide 30C according to this embodiment.

This example is almost the same as the example shown in FIG. 12, but in addition to the structure shown in FIG. 12, it has a roll 113 which guides the metal material 1 in the vertical direction.

A pressure applying means such as an air cylinder or a hydraulic cylinder may be installed on the roll 113 to apply pressure to the metal material 1. This support guide 30C guides the upper and lower surfaces and left and right surfaces of the metal material 1 on the exit side of the movable roller die 4 during bending. As a result, even if the hot worked portion undergoes the action of gravity of the metal material or of an additional moment in the vertical direction or to the left and right due to nonuniform thermal deformation caused by nonuniform heating and cooling, additional deformation of the metal material 1 can be prevented, and a bent product having a prescribed target shape without variations can be manufactured.

Figure 14:
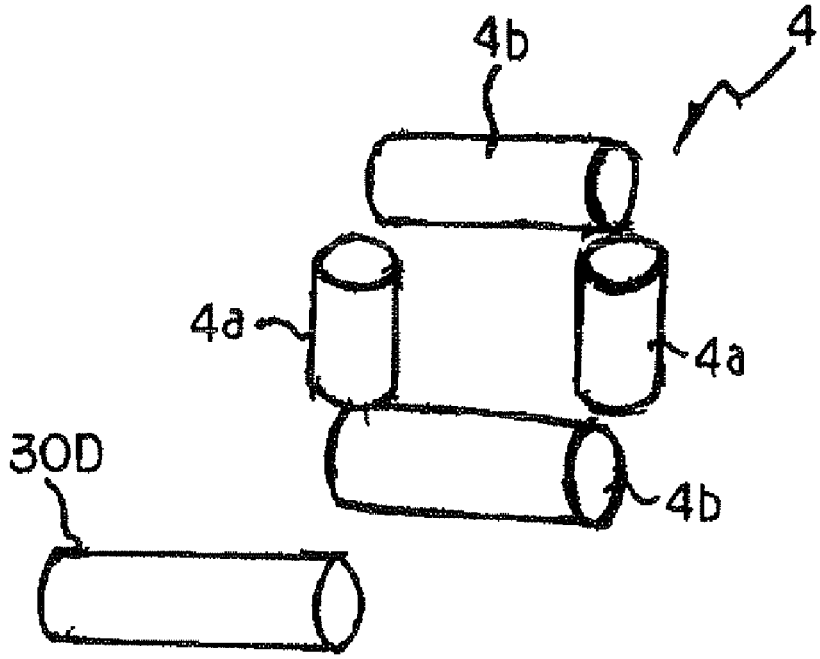
FIG. 14 is an explanatory view showing another example of a support guide.
Figure 14:
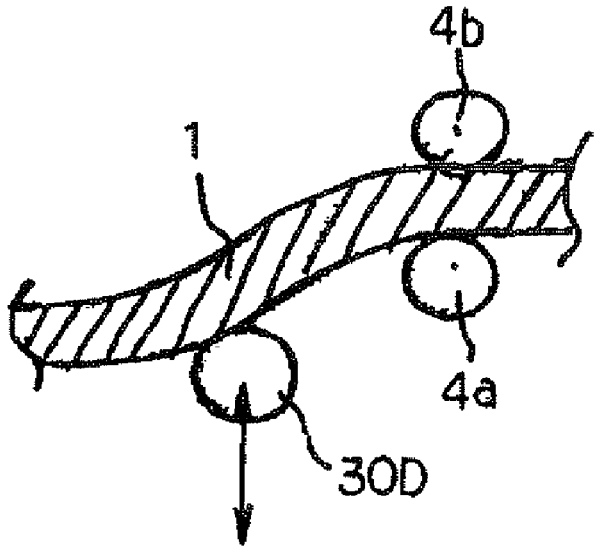

FIG. 14 is an explanatory view showing another example of a support guide 30 according to this embodiment. This is another example in which bending is carried out on a metal material 1 having a rectangular transverse cross section in the same manner as in FIG. 11, and the movable roller die 4 is of the four-roll type. A bent product with this embodiment has a completely three-dimensionally bent shape.

The movable roller die 4 moves to a prescribed spatial position during bending while positioning the end of the metal material 1 in the vertical direction and to the left and right. Namely, it is capable of horizontal shifting and left and right tilting, as well as movement in the vertical direction (referred to below as up and down shifting), and rotation in a horizontal plane (referred to below as up and down tilting).

In this embodiment, a roll-shaped active guide 30D is installed on the exit side of the movable roller die 4. The active guide 30D follows the bottom surface of the metal material 1 and continuously guides the bottom surface by moving in accordance with the movement of the metal material 1 during bending, i.e., by carrying out up and down shifting and left and right tilting. It is not necessary to carry out left and right tilting. These movements are transmitted to an unillustrated control means so as to synchronize with the feed device 3 and the movable roller die 4.

The lower surface of a metal material 1 is supported by the active guide 30D on the exit side of the movable roller die 4 during bending. Therefore, even if the hot worked portion undergoes the action of gravity of the metal material or of an additional moment in the vertical direction due to nonuniform thermal deformation caused by nonuniform heating and cooling, additional deformation of the metal material 1 can be prevented, and a bent product having a prescribed target shape without variations can be manufactured.

Figure 15:
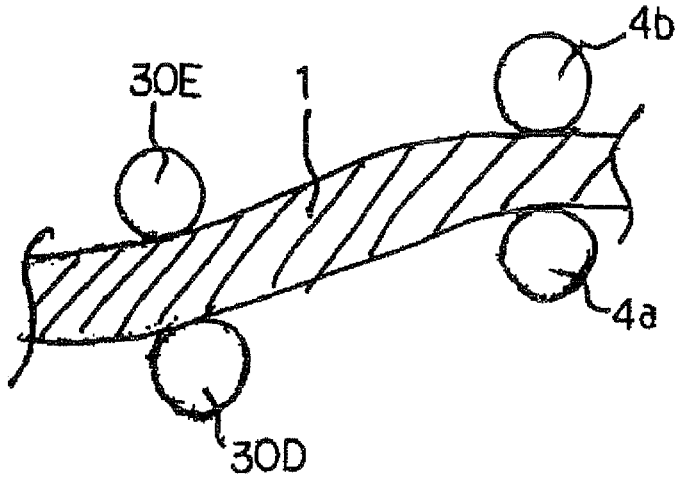
FIG. 15 is an explanatory view showing another example of a support guide.

FIG. 15 is an explanatory view showing another example of a support guide 30 according to this embodiment.

This embodiment has almost the same structure as in FIG. 7, but it additionally includes a roll 30E which guides a metal material 1 in the vertical direction.

Instead of roll 30E, it is possible to install a pressure applying means such as an air cylinder or a hydraulic cylinder. By guiding the upper and lower surfaces of the metal material 1 during bending by roll 30E on the exit side of the movable roller die 4, even if the hot worked portion undergoes the action of the metal material or of an additional moment in the vertical direction due to nonuniform thermal deformation caused by nonuniform heating and cooling, additional deformation of the metal material 1 can be prevented, and a bent product having a prescribed target shape without variations can be manufactured.

Figure 16:
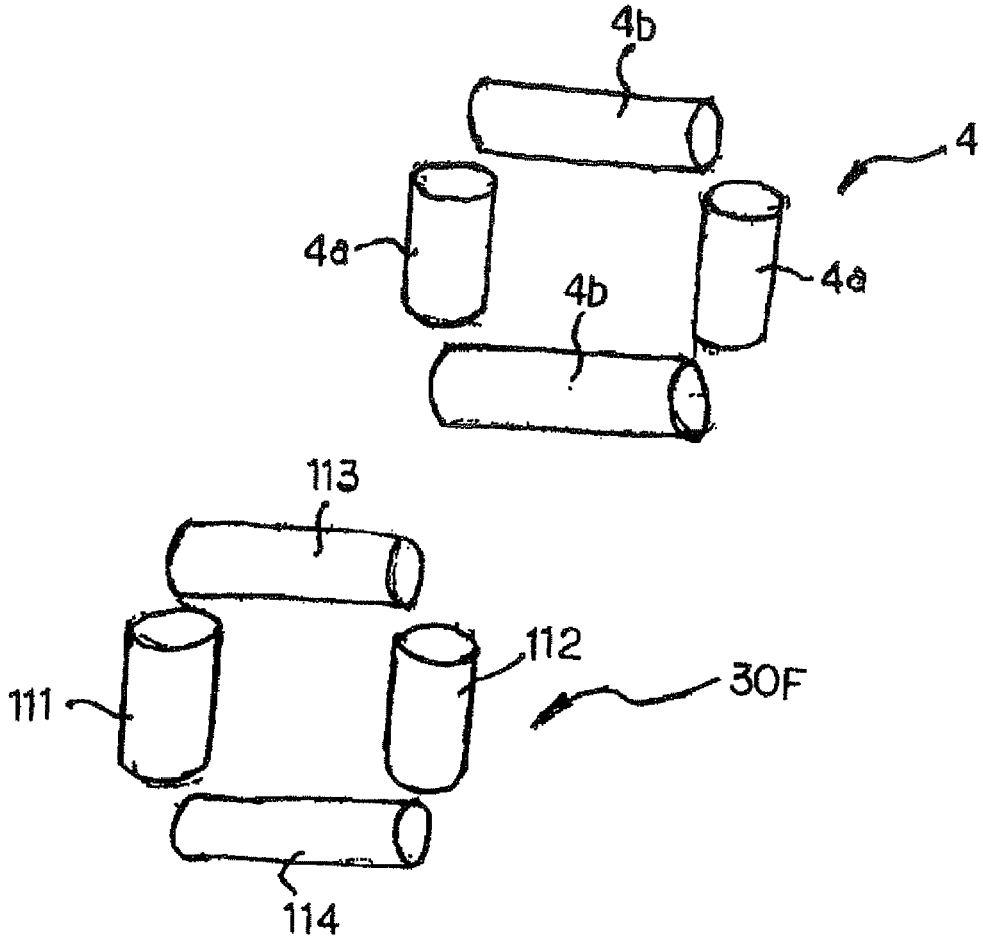
FIG. 16 is an explanatory view showing another example of a support guide.

FIG. 16 is an explanatory view of another example of a support guide 30 according to this embodiment.

This embodiment is also one in which bending is carried out on a metal material 1 which has a rectangular transverse cross section as in FIG. 11, and the movable roller die 4 is of the four-roll type. A completely three-dimensionally bent shape is imparted to the metal material 1. During bending, the movable roller die 4 carries out prescribed movement, i.e., horizontal shifting and left and right tilting, as well as up and down shifting and tilting while positioning the end of the metal material 1 in the vertical direction and to the left and right.

In the same manner as in the previous embodiments, in this embodiment, a guide 30F having four rolls 111-114 which guide a metal material 1 in the horizontal direction and the vertical direction is installed on the exit side of the movable roller die 4. The support guide 30F carries out movement in accordance with the movement of the metal material 1 during bending, i.e., it carries out horizontal shifting and left and right tilting. These movements are transmitted to an unillustrated control means so as to synchronize with the feed device 3 and the movable roller die 4.

A pressure applying means such as a hydraulic cylinder may be installed on one of rolls 111 and 112. Positioning of the lower surface and the left and right surfaces of the metal material 1 is achieved during bending on the exit side of the movable roller die 4. Therefore, even if the hot worked portion undergoes the action of gravity of the metal material or of an additional moment in the vertical direction or to the left and right due to nonuniform thermal deformation caused by nonuniform heating and cooling, additional deformation of the metal material 1 can be prevented, and a bent product having a prescribed target shape without variations can be obtained.

Figure 17:
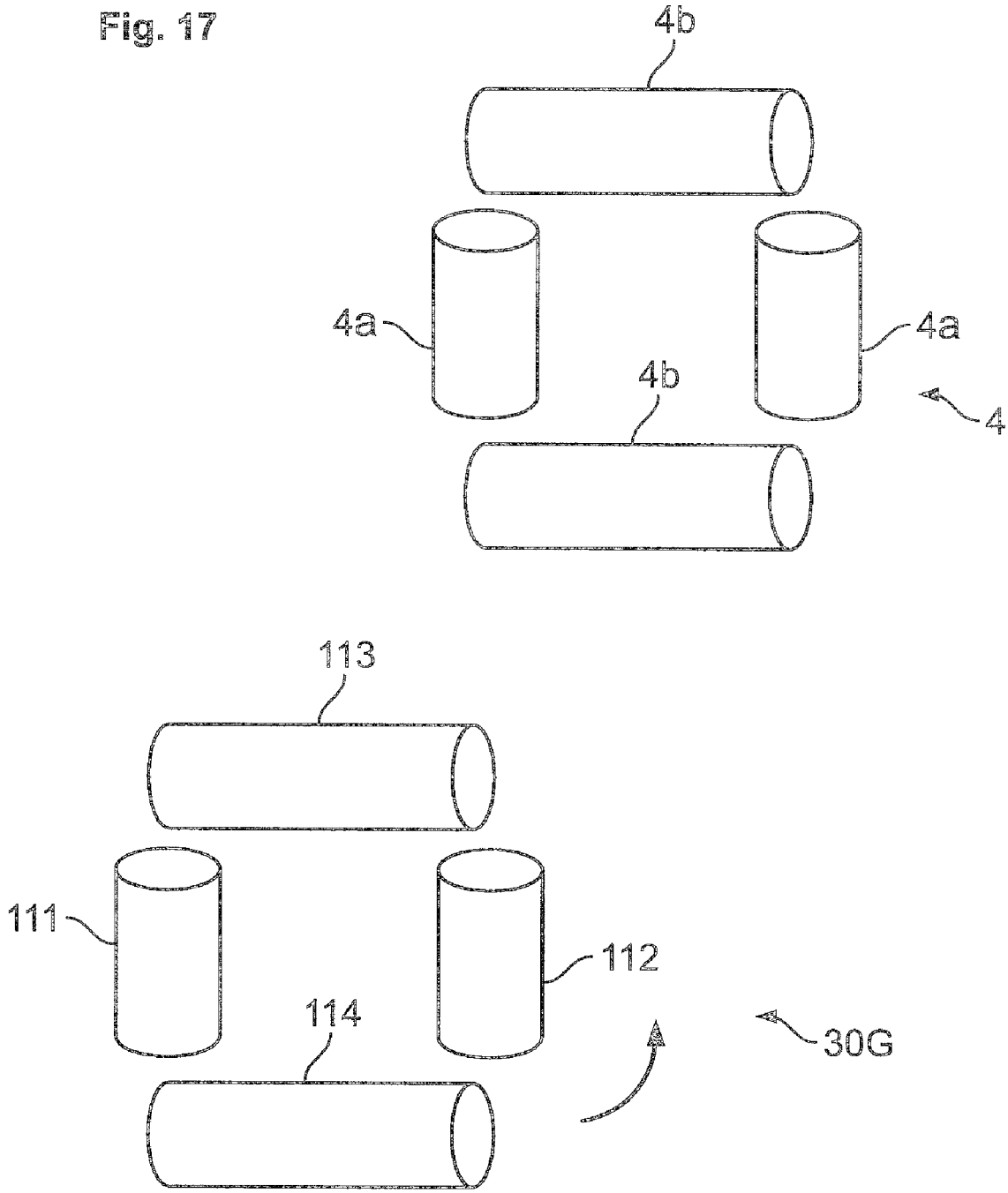
FIG. 17 is an explanatory view showing another example of a support guide.

FIG. 17 is an explanatory view showing another example of a support guide 30 according to this embodiment.

This example has almost the same structure as in FIG. 16, but in addition to the structure of FIG. 16, a twisting mechanism is added to a guide 30G.

This movement is transmitted to an unillustrated control means so as to synchronize with the feed device 3 and the movable roller die 4 which are disposed movably also in the twisting direction.

The support guide 30G guides the upper and lower surfaces and left and right surfaces of the metal material 1 on the exit side of the movable roller die 4 during bending. Therefore, even if the hot worked portion undergoes the action of gravity of the metal material or of an additional moment in the vertical direction or to the left and right or even in the twisting direction due to nonuniform thermal deformation caused by nonuniform heating and cooling, additional deformation of the metal material 1 can be prevented, and a bent product having a prescribed target shape without variations can be manufactured.

Although not shown in the drawings, as another example of support guide 30 of this embodiment, the support guide 30 may be held by a general-purpose multi-axis robot such that the support guide can be moved within a prescribed space.

As explained while referring to FIGS. 11-17, three-dimensional high-accuracy positioning mechanisms may be complicated. However, by using a general-purpose multi-axis robot, it is possible to move a support guide in a prescribed space with a relatively simple structure. At any rate, it can be determined whether to use a general-purpose multi-axis robot taking into consideration the stiffness and the like of the specific apparatus based on the required accuracy, the mass, and the shape of a product being formed by bending.

Figure 18:
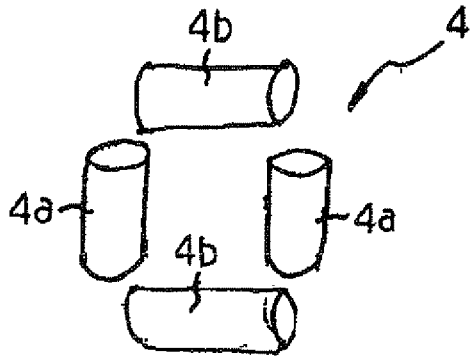
FIG. 18 is an explanatory view showing another example of a support guide.
Figure 18:
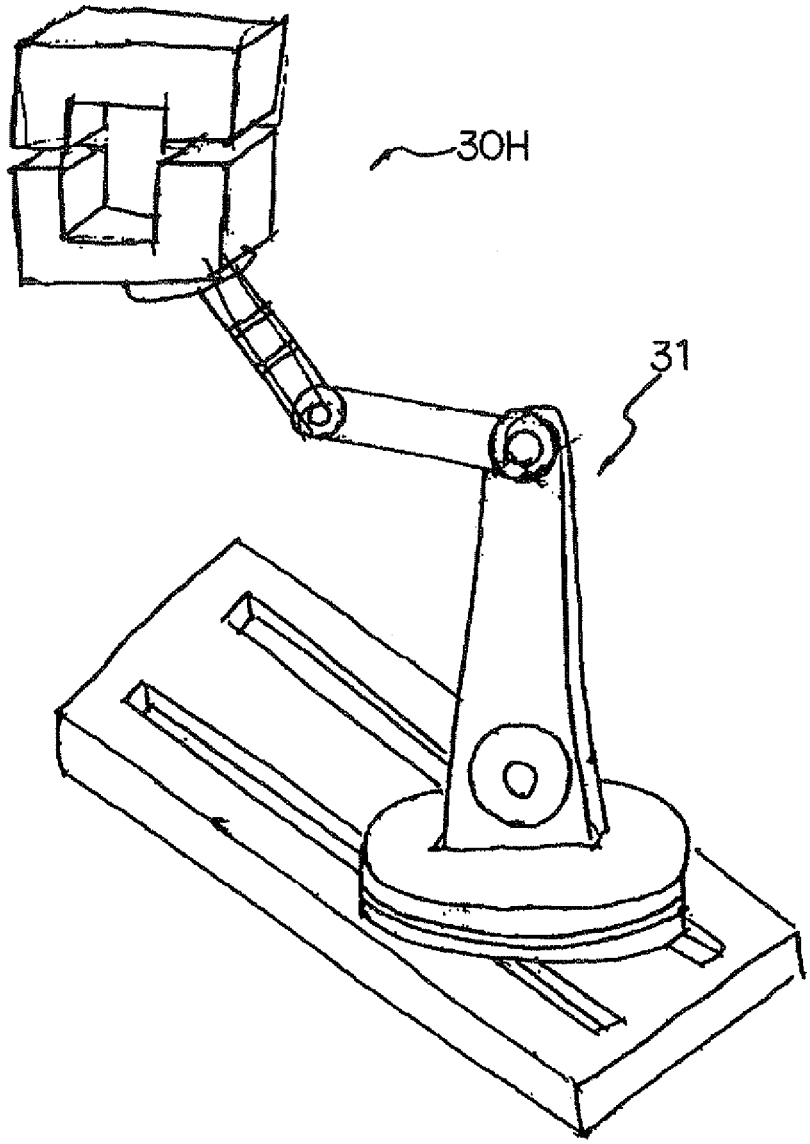

FIG. 18 is an explanatory view of another example of a support guide 30 according to this embodiment.

In this example, bending is carried out on a metal material 1 having a rectangular cross section as in FIG. 11, and the movable roller die 4 is a four-roll type. The bent product has a completely three-dimensionally bent shape. Namely, during bending, the movable roller die 4 moves to a prescribed spatial position by carrying out horizontal shifting and left and right tilting, as well as up and down shifting and up and down tilting while positioning the end of a metal material 1 in the vertical direction and to the left and right.

In contrast to the previous examples, in this example, the end of a metal material 1 is completely gripped by a support guide 30H which is held by a multi-axis robot 31, and the multi-axis robot 31 moves in accordance to the feeding of the metal material 1 so as to completely synchronize its three-dimensional position. In accordance with the movement of the metal material 1 during bending, the support guide 30H carries out movement of its spatial position, namely, by horizontal shifting and left and right tilting and twisting. These movements are transferred to an unillustrated control means and are synchronized with the operation of the feed device 3 and the movable roller die 4.

The end of the metal material 1 is held by the support guide 30H on the exit side of the movable roller die 4. Therefore, even if the hot worked portion undergoes the action of gravity of the metal material or of an additional moment in the vertical direction or to the left and right due to nonuniform thermal deformation caused by nonuniform heating and cooling, additional deformation of the metal material 1 can be prevented, and a bent product having a prescribed target shape without variations can be manufactured.

The support guide 30H for the end of the metal material preferably includes a mechanism for controlling the clamping force such that the clamping force is reduced when an excessive load is applied or when the effect of acceleration is experienced.

Of course, more complicated movement can be stably obtained by adding a servo-motor particularly at the wrist of a general-purpose articulated robot and increasing the number of movable axes.

(VI) Articulated Robot

Figure 19:
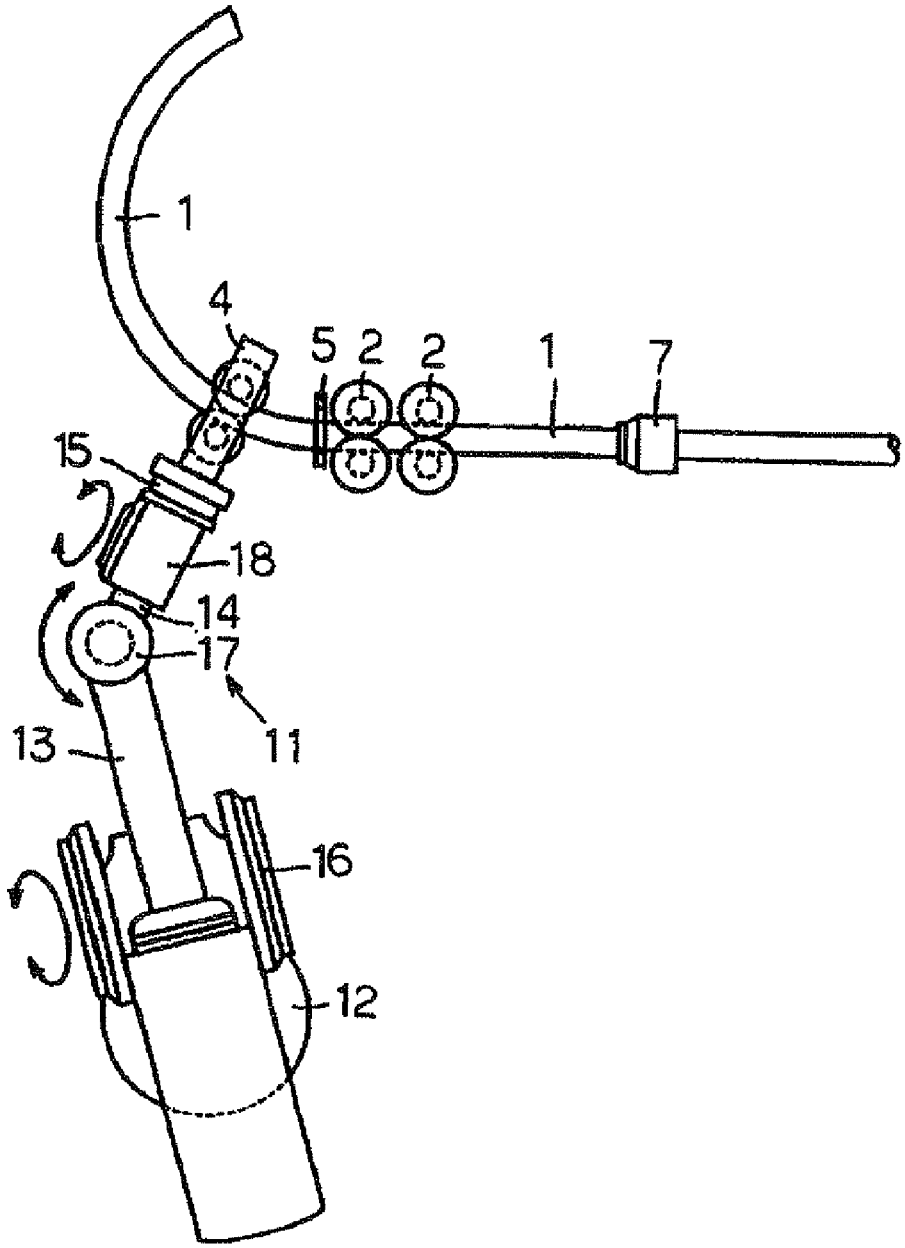
FIG. 19 is an explanatory view showing the structure of an articulated robot which can be used in a manufacturing apparatus of an embodiment.

FIG. 19 is an explanatory view showing the structure of an articulated robot 11 which can be used in a manufacturing apparatus 0 of the embodiment.

As shown in FIG. 19, an articulated robot 11 for holding a movable roller die 4 can be disposed on the downstream side of the bending apparatus.

This articulated robot 11 has a stationary surface 12 which is secured to a work plane, three arms 13, 14, and 15 which function as main axes, and three joints 16, 17, and 18 which connect the arms 13, 14, and 15 and which functions as wrists which can rotate about the axes. A movable roller die 4 is installed on arm 15 at the end of the articulated robot 11.

Figure 20:
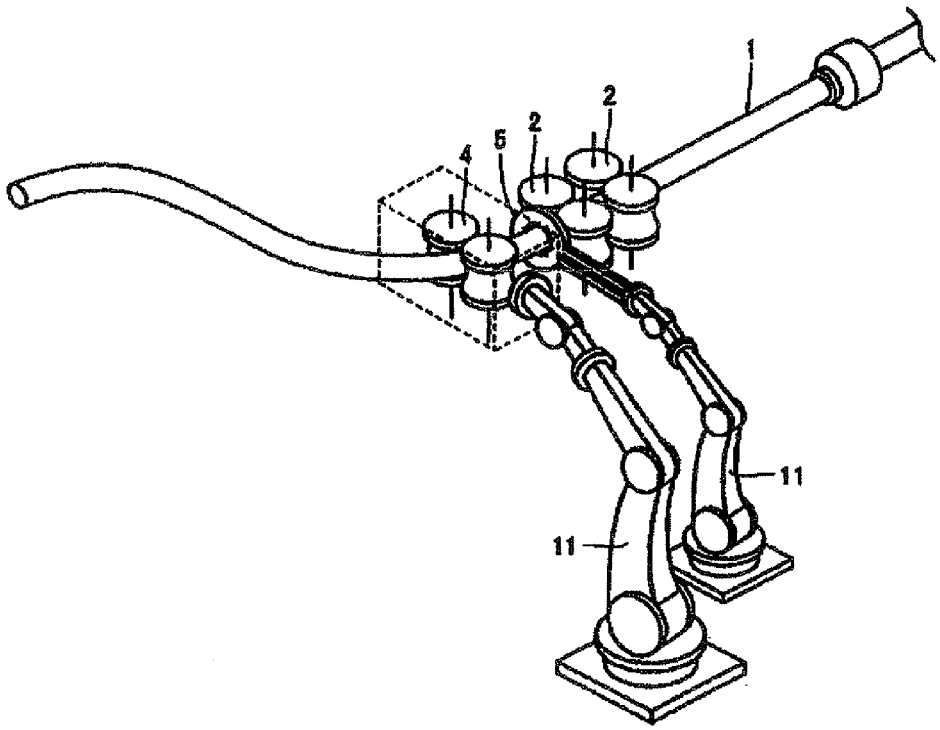
FIG. 20 is an explanatory view showing an example of the structure of another articulated robot which can be used in a manufacturing apparatus of an embodiment.

FIG. 20 is an explanatory view showing another example of the structure of an articulated robot used in a manufacturing apparatus 0 of this embodiment.

In the manufacturing apparatus 0 shown in FIG. 19, only an articulated robot 11 for holding the movable roller die 4 is provided. However, an articulated robot 11 for the heating device 5 and the cooling device 6 may also be provided. By providing these articulated robots 11, the efficiency of bending can be further increased.

In this manufacturing apparatus 0, by providing at least one articulated robot 11 having three joints which can each rotate about an axis, when carrying out bending of a metal material 1, movements such as bending, rotating, and translation carried out by a shifting mechanism, a tilting mechanism, and a moving mechanism of the movable roller die 4, namely, the movements carried out by total six types of manipulators can be performed by a series of operations in response to control signals. As a result, it is possible to increase the efficiency of bending as well as to decrease the size of a working apparatus.

(VII) Bending Line

As described above, a material with a closed cross section or an open cross section having a round shape or other shape is used as a material to be worked by a manufacturing apparatus 0 in this embodiment. Conventionally seam welded steel pipe has been used as round pipe having a closed cross section, and a steel material formed by roll forming has been used as a material having an open cross section.

Figure 21:
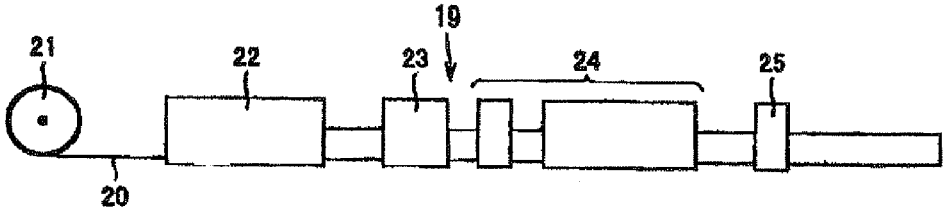
FIG. 21 is an explanatory view showing the overall process for manufacturing a seam welded steel pipe, which is one example of a material to be worked.

FIG. 21 is an explanatory view of the overall manufacturing process of a seam welded steel pipe which is an example of a material being worked.

A manufacturing process 19 for a seam welded steel pipe constitutes an apparatus for manufacturing a steel pipe from a steel strip 20. As shown in the figure, an uncoiler 21 which continuously pays off a steel strip 20 from a roll, a forming means 22 having a plurality of roll formers which form the uncoiled steel strip 20 into a pipe having a predetermined cross-sectional shape, a welding means 23 having a welding machine which welds both edges of the steel strip which have been abutted against each other to obtain a tubular shape and continuously form a pipe, an after-treatment means 24 comprising a weld bead cutting machine and a post-annealer and capable of forming the continuous pipe into a predetermined size, and a cutting means 25 having a running cutter which cuts the pipe which is given a predetermined size into a desired length are sequentially arranged from the upstream side towards the downstream side.

Figure 22:
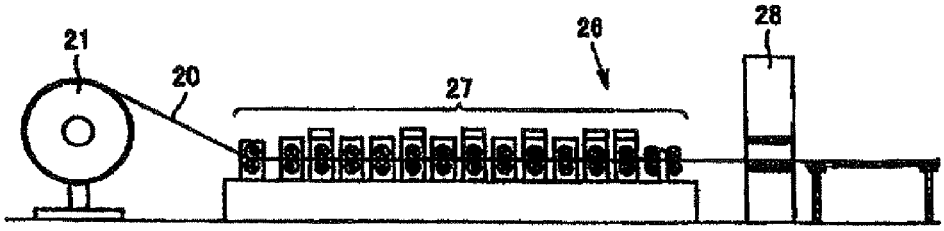
FIG. 22 shows the overall structure of a roll forming process used in the manufacture of a material to be worked.

FIG. 22 shows the overall structure of a roll forming process used in manufacturing a material being worked.

The roll forming process 26 constitutes an apparatus for forming a steel strip 20 into a predetermined shape. For this purpose, it comprises an uncoiler 21 around which a metal material in the form of a steel strip 20 is wrapped and which pays off the steel strip 20, a forming means 27 having a roll former which forms the steel strip 20 which is paid off by the uncoiler 21 into a predetermined shape, and a cutting means 28 having a running cutter which continuously cuts the steel strip 20 which was formed into a predetermined shape by the roll former to a desired length.

A material being worked which is manufactured by the manufacturing process 19 for a seam welded steel pipe shown in FIG. 21 or the roll forming process 26 shown in FIG. 22 is supplied to a bending apparatus as a metal material being worked. If the continuous line of this process and the bending apparatus are separated from and independent of each other, due to differences in the processing speed of the line and the apparatus, it becomes necessary to provide a place for stocking the material being worked. In addition, it is necessary to transport the material being worked between each line and the apparatus, and it becomes necessary to provide an auxiliary transport means such as a crane or a truck.

In a manufacturing apparatus of this embodiment, by disposing a manufacturing apparatus 0 of this embodiment on the exit side of a manufacturing process 19 for a seam welded pipe or a roll forming process 26, the overall manufacturing line from supply of the material being worked to the manufacture of a bent product can be made compact. In addition, by suitably setting the operating conditions, a product formed by working having excellent accuracy can be efficiently and inexpensively manufactured.

Figure 23:
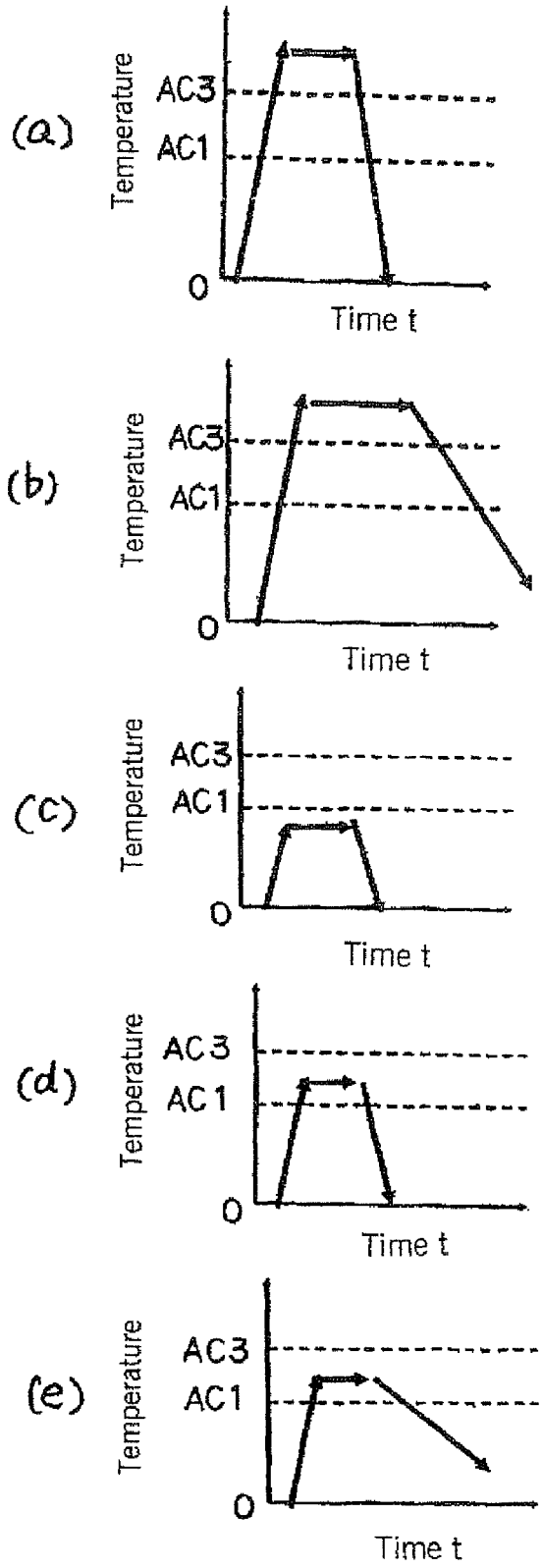
FIG. 23(*a*) is a graph showing the usual quenching conditions by rapid cooling after heating to at least the $Ac_3$ point, FIG. 23(*b*) is a graph showing the conditions when cooling at a cooling rate which is lower than the cooling rate shown in FIG. 23(*a*) after heating to at least the $Ac_3$ point, FIG. 23(*c*) is a graph showing the conditions for rapid cooling after heating to at most the $Ac_1$ point, FIG. 23(*d*) is a graph showing the conditions for rapid cooling after heating to a temperature region of at least the $Ac_1$ point to at most the $Ac_3$ point, and FIG. 23(*e*) is a graph showing the conditions for cooling at a cooling rate lower than the cooling rate shown in FIG. 23(*d*) after heating to a temperature region of at least the $Ac_1$ point and at most the $Ac_3$ point.

FIG. 23 shows various heat treatment conditions obtained by a manufacturing apparatus of this embodiment. FIG. 23(*a*) is a graph showing normal quenching conditions obtained by rapid cooling after heating to at least the $Ac_3$ point. FIG. 23(*b*) is a graph showing conditions in which cooling is performed at a cooling rate which is lower than the cooling rate shown in FIG. 23(*a*) after heating to at least the $Ac_3$ point. FIG. 23(*c*) is a graph showing conditions of rapid cooling after heating to a temperature lower than the $Ac_1$ point.

FIG. 23(*d*) is a graph showing conditions of rapid cooling after heating to a temperature range of at least the $Ac_1$ point to at most the $Ac_3$ point. FIG. 23(*e*) is a graph showing conditions of cooling at a cooling rate lower than the cooling rate shown in FIG. 23(*d*) after heating to a temperature range of at least the $Ac_1$ point and at most the $Ac_3$ point.

Heat treatment is carried out by the usual quenching shown in FIG. 23(*a*) or under the conditions shown in FIGS. 23(*b*)-23(*e*) by suitably controlling the operation of the high frequency heating coil 5 and the water cooling device 6 in the above-described manufacturing apparatus 0.

For example, by locally carrying out usual quenching as shown in FIG. 23(*a*), a desired ultra-high strength (for example, 1500-1650 MPa for a 100% martensite structure steel, 1300 MPa for a 550 MPa steel, 1200 MPa for a 450 MPa steel) can be obtained on the quenched portion, and by turning the high frequency coil 5 off and not carrying out heat treatment locally, a portion of the pipe which is not quenched can remain to have the initial strength of the untreated pipe (for example, 500-600 MPa for a quench-hardenable steel of ferrite and pearlite two-phase structure, 550 MPa for a 550 MPa steel, and 450 MPa for a 450 MPa steel).

By performing heating corresponding to usual quenching and then cooling at a decreased cooling rate as shown in FIG. 23(*b*), a high strength which is slightly lower than the above-described ultra-high strength can be achieved (for example, 1400-1500 MPa for a quench-hardenable steel of two-phase structure comprising martensite and a minute amount of ferrite, 700-900 MPa for a 550 MPa steel, and 600-800 MPa for a 450 MPa steel). Specifically, by entirely or partially closing off the holes in a water cooling jacket of the water cooling device 6 using solenoid valves, for example, it is possible to provide portions which are not water cooled. Since the cooling rate varies with the surrounding temperature, experiments can be previously carried out based on the manufacturing conditions to determine a method of water cooling.

As shown in FIG. 23(*c*), by heating to at most the $Ac_1$ point and then cooling at a cooling rate which is the same as the cooling rate for normal quenching, a desired strength which is somewhat higher than the strength of the base metal can be obtained (for example, a strength slightly higher than 500-600 MPa for a quench-hardenable steel of ferrite and pearlite two phase structure, a strength slightly higher than 550 MPa for a 550 MPa steel, and a strength slightly higher than 450 MPa for a 450 MPa steel). In the case of an untreated pipe having a large strain produced during pipe forming, the strength after heat treatment is sometimes lower than that of the untreated pipe, but in general the strength is slightly increased by dissolution of cementite. Taking into consideration the responsiveness of control of the high frequency heating coil 5 when carrying out the above-described on-off control, variations in the output of the power supply for heating are reduced by this heat treatment method. Therefore, the response to temperature variations is rapid, and the transition zone of changes in strength become small, so this method is effective from a practical standpoint.

As shown in FIG. 23(*d*), by heating to at least the $Ac_1$ point and at most the $Ac_3$ point and then cooling at the same cooling rate as for usual quenching, a strength between the ultra-high strength obtained by usual quenching and the strength of an untreated pipe can be obtained (600-1400 MPa for quench-hardenable steel, 550-1300 MPa for 550 MPa steel, and 450-1200 MPa for 450 MPa steel). In this case, a two-phase structure of ferrite and martensite is formed, so in general, the manufacturing method is somewhat unstable and difficult to control. However, depending upon the shape, dimensions, and use of the product, an appropriate strength can be obtained.

As shown in FIG. 23(*e*), by heating to at most the $Ac_1$ point and then cooling at a cooling rate which is slower than the cooling rate for usual quenching, a strength between the ultra-high strength due to usual quenching and the strength of the untreated pipe can be obtained (a strength somewhat lower than 600-1400 MPa for quench-hardenable steel, a strength somewhat lower than 550-1300 MPa for a 550 MPa steel, and a strength somewhat lower than 450-1200 MPa for a 450 MPa steel). In this case, the strength is somewhat lower than the case shown in FIG. 23(*d*), but control is fairly stable.

For example, in the case of a steel pipe with a square cross section with cross-sectional dimensions of 50 mm in height and 50 mm in width formed from quench-hardenable steel with a wall thickness of 1.6 mm (C: 0.20%, Si: 0.22%, Mn: 1.32%, P: 0.016%, S: 0.002%, Cr: 0.20%, Ti: 0.020%, B: 0.0013%, remainder of Fe and impurities, $Ac_3$=825° C., $Ac_1$=720° C.) which was fed at a speed of 20 mm per second, the strength of the untreated pipe was 502 MPa, the strength of the heat-treated portion under the conditions shown in FIG. 23(*a*) (heating temperature of 910° C.) was 1612 MPa, the strength of the heat-treated portion under the conditions shown in FIG. 23(*b*) (heating temperature of 910° C.) was 1452 MPa, the strength of the heat-treated portion under the conditions shown in FIG. 23(*c*) (heating temperature of 650° C.) was 510 MPa, the strength of the heat-treated portion under the conditions shown in FIG. 23(*d*) (heating temperature of 770° C.) was 752 MPa, and the strength of the heat-treated portion under the conditions shown in FIG. 23(*e*) (heating temperature of 770° C.) was 623 MPa.

On the other hand, in the case of a steel pipe having a square cross section with dimensions of 50 mm high and 50 mm wide formed from a 550 MPa steel with a thickness of 1.6 mm (C: 0.14%, Si: 0.03%, Mn: 1.30%, P: 0.018%, S: 0.002%, a remainder of Fe and impurities, $Ac_3$=850° C., $Ac_1$=720° C.) which was fed at a speed of 20 mm per second, the strength of the untreated pipe was 554 MPa, the strength of the heat-treated portion under the conditions shown in FIG. 23(*a*) (heating temperature of 950° C.) was 1303 MPa, the strength of the heat-treated portion under the conditions shown in FIG. 23(*b*) (heating temperature of 950° C.) was 823 MPa, the strength of the heat-treated portion under the conditions shown in FIG. 23(*c*) (heating temperature of 650° C.) was 561 MPa, the strength of the heat-treated portion under the conditions shown in FIG. 23(*d*) (heating temperature of 800° C.) was 748 MPa, and the strength of the heat-treated portion under the conditions shown in FIG. 23(*e*) (heating temperature of 800° C.) was 658 MPa.

In the case of a steel pipe with a square cross section measuring 50 mm in height and 50 mm in width formed from a steel with a strength of 450 MPa and a thickness of 1.6 mm (C: 0.11%, Si: 0.01%, Mn: 1.00%, P: 0.021%, S: 0.004%, remainder of Fe and impurities, $Ac_3$=870° C., $Ac_1$=720° C.) which was fed at a speed of 20 mm per second, the strength of the untreated pipe was 445 MPa, the strength of the heat-treated portion under the conditions shown in FIG. 23(*a*) (heating temperature of 980° C.) was 1208 MPa, the strength of the heat-treated portion under the conditions shown in FIG. 23(*b*) (heating temperature of 980° C.) was 737 MPa, the strength of the heat-treated portion under the conditions shown in FIG. 23(*c*) (heating temperature of 650° C.) was 451 MPa, the strength of the heat-treated portion under the conditions shown in FIG. 23(*d*) (heating temperature of 800° C.) was 629 MPa, and the strength of the heat-treated portion under the conditions shown in FIG. 23(*e*) (heating temperature of 800° C.) was 612 MPa.

In this manner, according to this embodiment, even in the case of bending in which a diverse bent shape is required with the bending direction of a metal material varying two-dimensionally or three-dimensionally, and even when it is necessary to perform bending of a metal material having a high strength, the metal material can be uniformly cooled, and hence, even with a high strength material, the shape retention is good and a bent product having a uniform hardness distribution can be efficiently and inexpensively manufactured.

In addition, a movable roller die can support a metal material so as to be able to move in its axial direction, so seizing scratches which develop on the surface of the movable roller die can be suppressed, bending accuracy can be guaranteed, and bending can be carried out with excellent operating efficiency. As a result, the present invention can be widely applied as a bending technique for automotive parts which are becoming increasingly strong.

EXAMPLE 1

The present invention will be explained more concretely while referring to examples.

Figure 24:
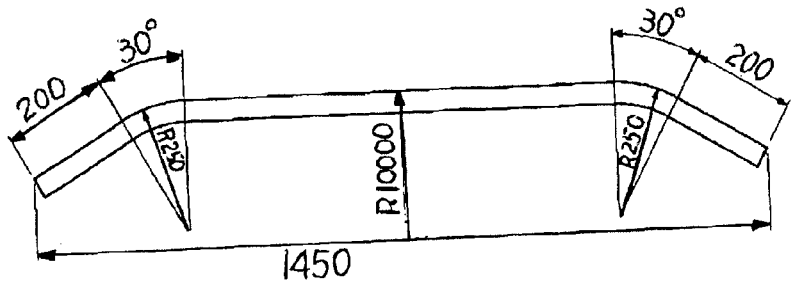
FIG. 24 is an explanatory view showing the dimensions of a bent product in a first embodiment.

Using a steel pipe with a wall thickness of 1.6 mm and a square cross section having a height and width each measuring 40 mm as a starting material, a bent product having the external appearance shown in FIG. 24 was manufactured using the bending apparatus according to the present invention which was explained while referring to FIG. 1.

In this example, bent products prepared in a conventional example which was manufactured without using a support according to the present invention, Example 1 of the present invention which was manufactured using the support guide 30A shown in FIG. 11, and Example 2 of the present invention which was manufactured using the support guide 30B shown in FIG. 12 were measured using a non-contacting three-dimensional measuring device to determine the maximum deviation from a target value (dimensional accuracy).

The support guide 30A shown in FIG. 11 had a table secured to an unillustrated housing of the movable roller die 4 (the rollers of the movable roller die are shown by 4*a* and 4*b*). The table was made of S45C steel with a thickness of 10 mm.

The support guide 30B shown in FIG. 12 had a table roller like that shown in FIG. 11 and movable vertical rolls 111 and 112 which were installed on the table so that they could move in synchrony with the movable roller die. The vertical rolls each had a body portion made of SKD11 with an outer diameter of 50 mm and a height of 70 mm. The vertical rolls had unillustrated small-diameter ends which were supported by bearings so that the vertical rolls could rotate when supporting a metal material.

Figure 25:
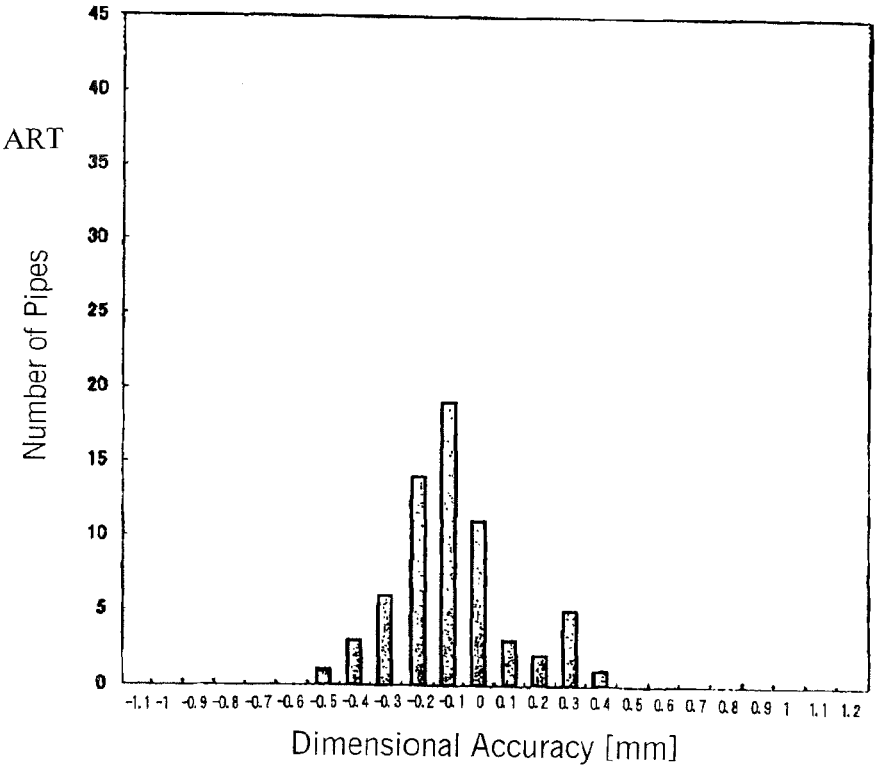
Fig. 25 PRIOR ART
FIG. 25 is a graph showing the results of Conventional Example 1.
Figure 26:
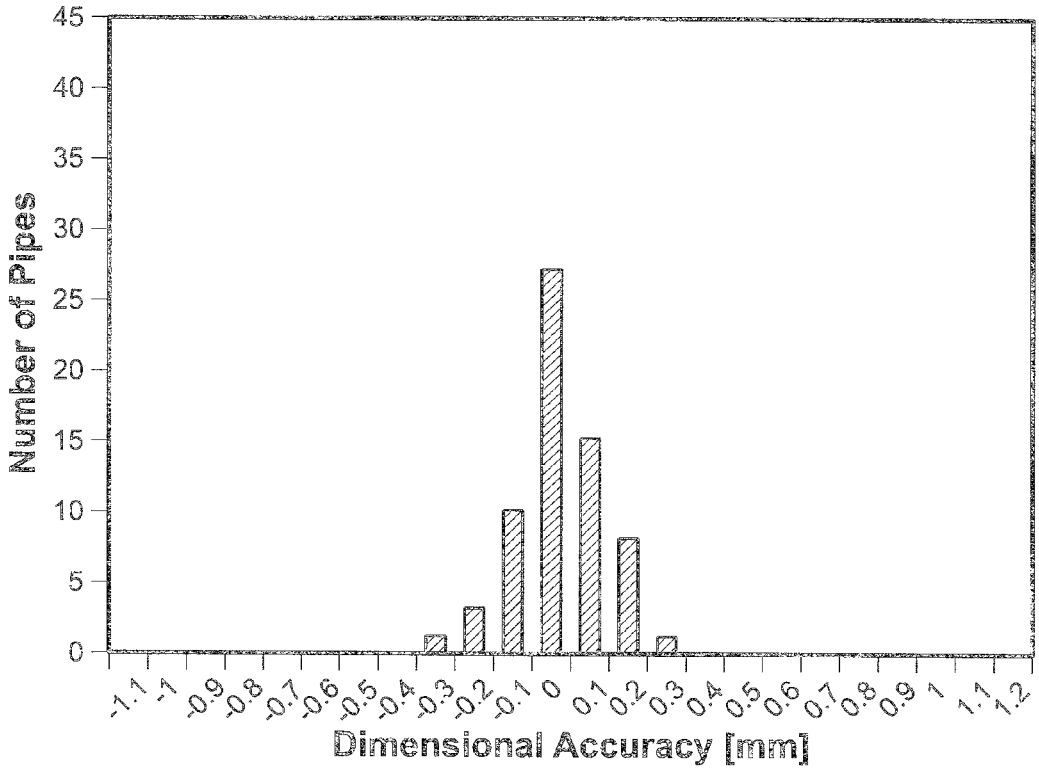
FIG. 26 is a graph showing the results of Example 1 of the present invention.
Figure 27:
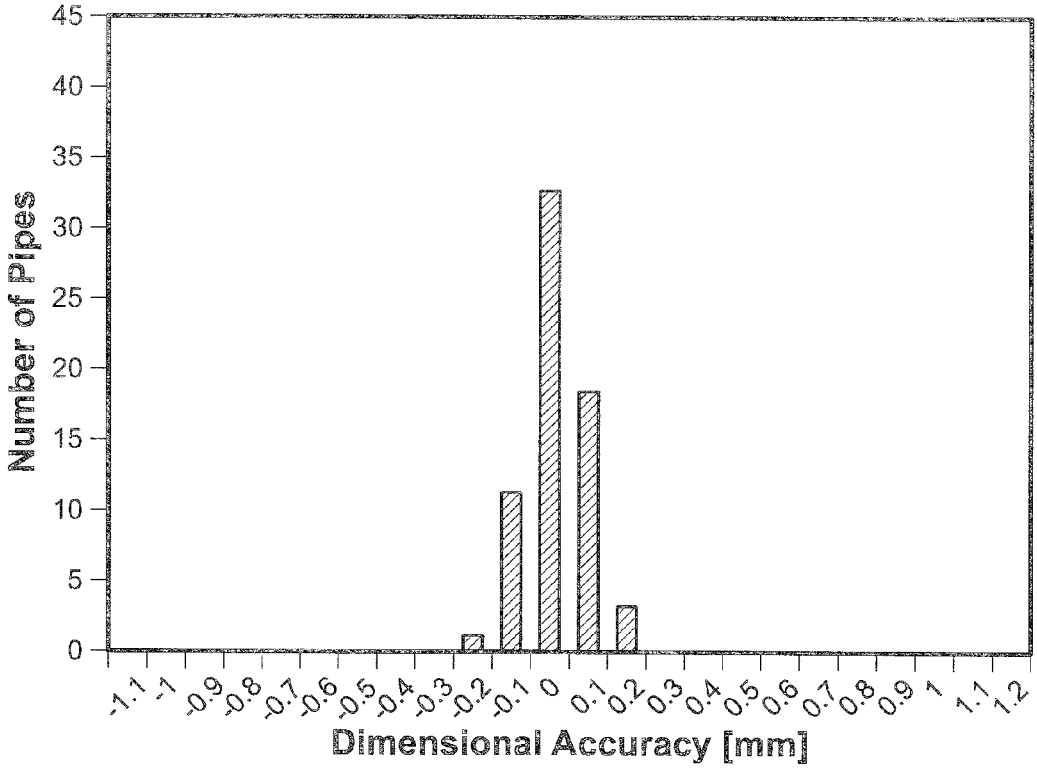
FIG. 27 is a graph showing the results of Example 2 of the present invention.

The results for a comparative example and Examples 1 and 2 of the present invention are shown in Tables 1-3 and in the graphs of FIGS. 25-27.

TABLE 1

| Conventional Example 1 | | | |
|---|---|---|---|
| Accuracy | | | |
| At least | Less than | Class mark | Number |
| 0 | 0.1 | −1.1 | |
| 0.1 | 0.2 | −1 | |
| 0.2 | 0.3 | −0.9 | |
| 0.3 | 0.4 | −0.8 | |
| 0.4 | 0.5 | −0.7 | |
| 0.5 | 0.6 | −0.6 | |
| 0.6 | 0.7 | −0.5 | 1 |
| 0.7 | 0.8 | −0.4 | 3 |
| 0.8 | 0.9 | −0.3 | 6 |
| 0.9 | 1 | −0.2 | 14 |
| 1 | 1.1 | −0.1 | 19 |
| 1.1 | 1.2 | 0 | 11 |
| 1.2 | 1.3 | 0.1 | 3 |
| 1.3 | 1.4 | 0.2 | 2 |
| 1.4 | 1.5 | 0.3 | 5 |
| 1.5 | 1.6 | 0.4 | 1 |
| | | 0.5 | |
| | | 0.6 | |
| | | 0.7 | |
| | | 0.8 | |
| | | 0.9 | |
| | | 1 | |
| | | 1.1 | |
| | | 1.2 | |

TABLE 2

| Example 1 | | | |
|---|---|---|---|
| Accuracy | | | |
| At least | Less than | Class mark | Number |
| 0 | 0.1 | −1.1 | |
| 0.1 | 0.2 | −1 | |
| 0.2 | 0.3 | −0.9 | |
| 0.3 | 0.4 | −0.8 | |
| 0.4 | 0.5 | −0.7 | |
| 0.5 | 0.6 | −0.6 | |
| 0.6 | 0.7 | −0.5 | |
| 0.7 | 0.8 | −0.4 | |
| 0.8 | 0.9 | −0.3 | 1 |
| 0.9 | 1 | −0.2 | 3 |
| 1 | 1.1 | −0.1 | 10 |
| 1.1 | 1.2 | 0 | 27 |
| 1.2 | 1.3 | 0.1 | 15 |
| 1.3 | 1.4 | 0.2 | 8 |
| 1.4 | 1.5 | 0.3 | 1 |
| 1.5 | 1.6 | 0.4 | |
| | | 0.5 | |
| | | 0.6 | |
| | | 0.7 | |
| | | 0.8 | |
| | | 0.9 | |
| | | 1 | |
| | | 1.1 | |
| | | 1.2 | |

TABLE 3

| Example 2 | | | |
|---|---|---|---|
| Accuracy | | | |
| At least | Less than | Class mark | Number |
| 0 | 0.1 | −1.1 | |
| 0.1 | 0.2 | −1 | |
| 0.2 | 0.3 | −0.9 | |
| 0.3 | 0.4 | −0.8 | |
| 0.4 | 0.5 | −0.7 | |
| 0.5 | 0.6 | −0.6 | |
| 0.6 | 0.7 | −0.5 | |
| 0.7 | 0.8 | −0.4 | |
| 0.8 | 0.9 | −0.3 | |
| 0.9 | 1 | −0.2 | |
| 1 | 1.1 | −0.1 | 1 |
| 1.1 | 1.2 | 0 | 11 |
| 1.2 | 1.3 | 0.1 | 32 |
| 1.3 | 1.4 | 0.2 | 18 |
| 1.4 | 1.5 | 0.3 | 3 |
| 1.5 | 1.6 | 0.4 | |
| | | 0.5 | |
| | | 0.6 | |
| | | 0.7 | |
| | | 0.8 | |
| | | 0.9 | |
| | | 1 | |
| | | 1.1 | |
| | | 1.2 | |

As shown in Tables 1-3 and the graphs of FIGS. 25-27, the dimensional accuracy of Examples 1 and 2 was much better than that of the conventional example. In Example 2 of the present invention which used a support guide which constrained movement to the left and right in addition to the effect of preventing bending due to gravity provided by the support guide of Example 1 of the present invention, good dimensional accuracy of at most ±0.2 mm was obtained.

EXAMPLE 2

Figure 28:
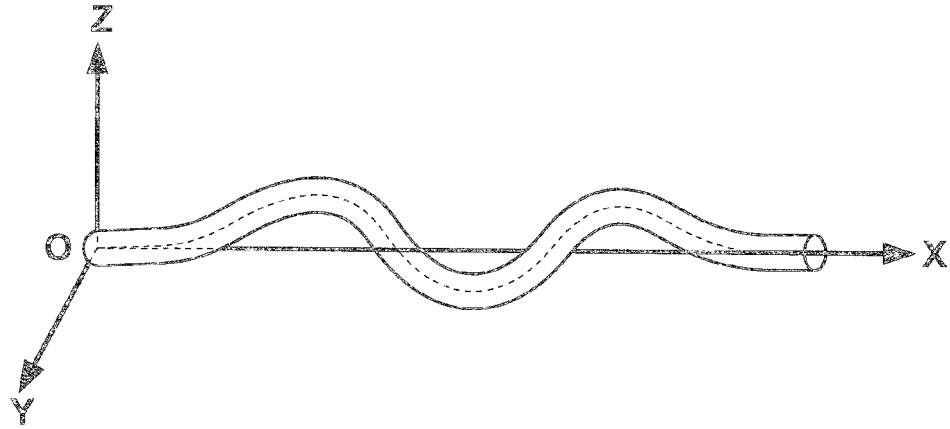
FIG. 28(*a*) is an explanatory view showing the external appearance of a bent product in a second embodiment, and FIG. 28(*b*) is a graph showing the dimensions of this bent product.
Figure 28:
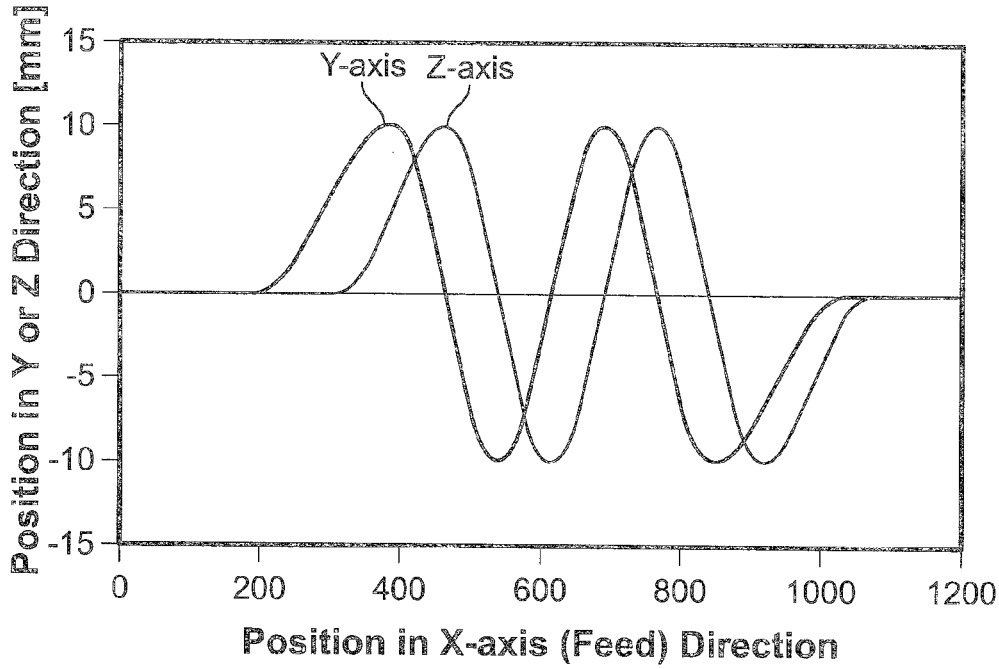

Using a steel pipe having a wall thickness of 2.1 mm and a circular transverse cross-sectional shape with an outer diameter of 31.8 mm as a starting material, a product having a completely three-dimensional spiral bend and having the external appearance shown in FIG. 28(*a*) and the dimensions shown in FIG. 28(*b*) was manufactured using a bending apparatus according to the present invention which was explained with respect to FIG. 1.

Products of Conventional Example 2, which was manufactured without using the support of the present invention, and Example 3 of the present invention, which was manufactured using the support guide 30G shown in FIG. 17, were measured using a non-contacting three-dimensional measuring device to determine the maximum value of the deviation from a target value (dimensional accuracy).

Figure 35:
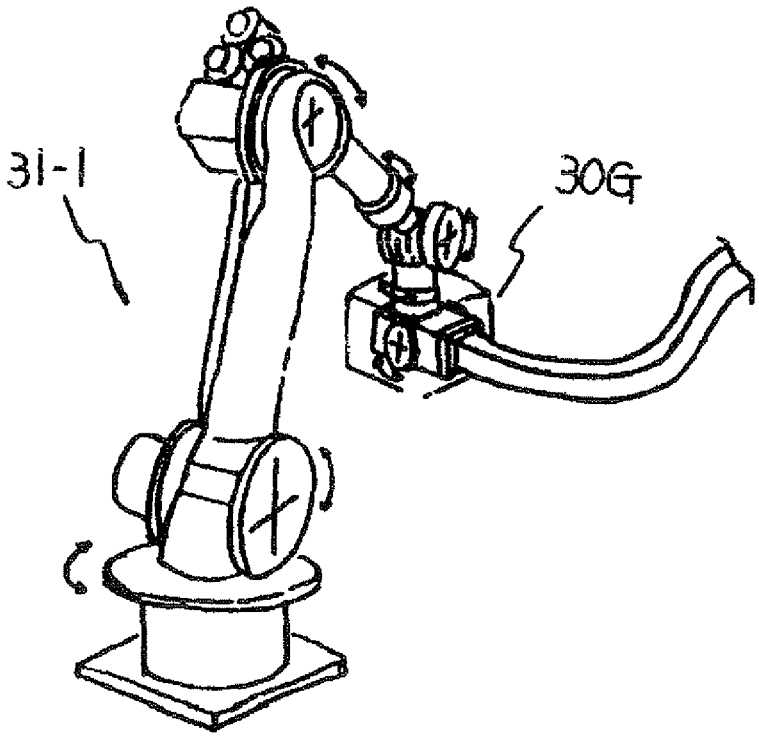
FIG. 35 is an explanatory view showing a support mechanism of a support guide in a second embodiment.

In this example, the support guide 30G shown in FIG. 17 was supported using the articulated robot 31-1 shown in FIG. 35. The support guide was used to clamp the end of the metal material and moved three-dimensionally in synchrony with the movement of the movable roller die.

Figure 29:
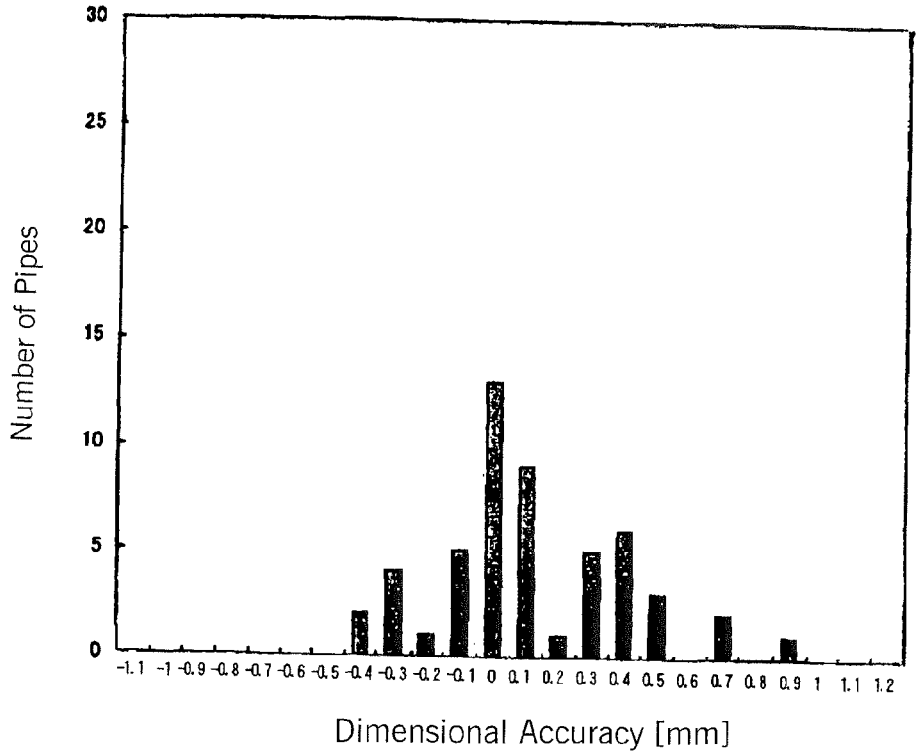
Fig. 29 PRIOR ART
FIG. 29 is a graph showing the results of Conventional Example 2.
Figure 30:
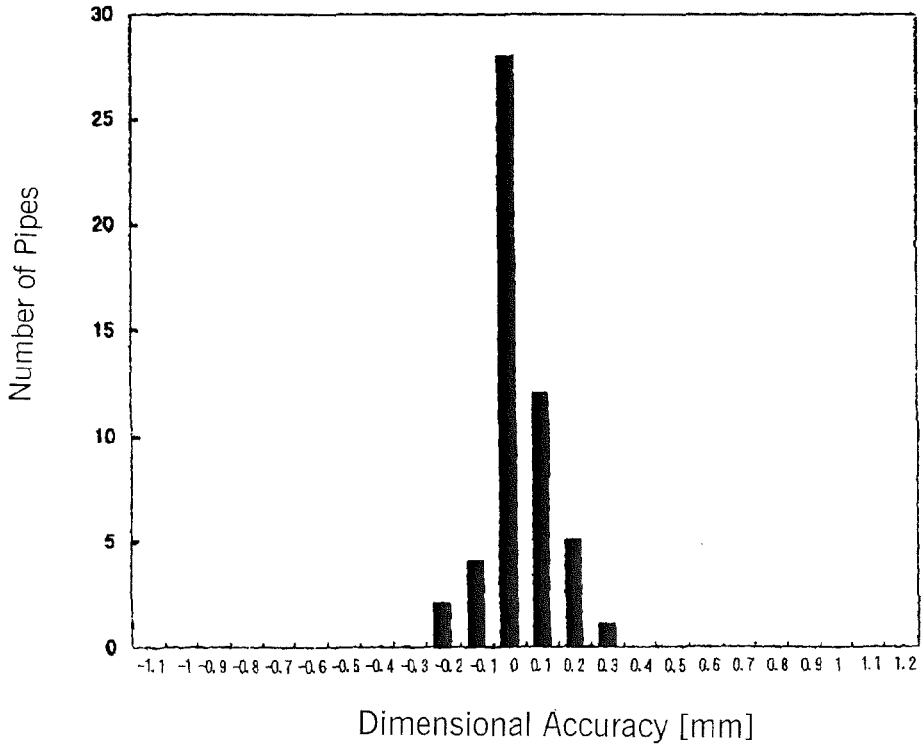
FIG. 30 is a graph showing the results of Example 3 of the present invention.

The results for Conventional Example 2 and Example 3 of the present invention are shown in Tables 4 and 5 and in the graphs of FIGS. 29 and 30.

TABLE 4

| Conventional Example 2 | | | |
|---|---|---|---|
| Accuracy | | | |
| At least | Less than | Class mark | Number |
| | | −1.1 | |
| | | −1 | |
| | | −0.9 | |
| | | −0.8 | |
| | | −0.7 | |
| | | −0.6 | |
| | | −0.5 | |
| | | −0.4 | 2 |
| | | −0.3 | 4 |
| | | −0.2 | 1 |
| | | −0.1 | 5 |
| | | 0 | 13 |
| 0 | 0.1 | 0.1 | 9 |
| 0.1 | 0.2 | 0.2 | 1 |
| 0.2 | 0.3 | 0.3 | 5 |
| 0.3 | 0.4 | 0.4 | 6 |
| 0.4 | 0.5 | 0.5 | 3 |
| 0.5 | 0.6 | 0.6 | 0 |
| 0.6 | 0.7 | 0.7 | 2 |
| 0.7 | 0.8 | 0.8 | |
| 0.8 | 0.9 | 0.9 | 1 |
| 0.9 | 1 | 1 | |
| 1 | 1.1 | 1.1 | |
| 1.1 | 1.2 | 1.2 | |

TABLE 5

| Example 3 | | | |
|---|---|---|---|
| Accuracy | | | |
| At least | Less than | Class mark | Number |
| | | −1.1 | |
| | | −1 | |
| | | −0.9 | |
| | | −0.8 | |
| | | −0.7 | |
| | | −0.6 | |
| | | −0.5 | |
| | | −0.4 | |
| | | −0.3 | |
| | | −0.2 | 2 |
| | | −0.1 | 4 |
| | | 0 | 28 |
| 0 | 0.1 | 0.1 | 12 |
| 0.1 | 0.2 | 0.2 | 5 |
| 0.2 | 0.3 | 0.3 | 1 |
| 0.3 | 0.4 | 0.4 | 0 |
| 0.4 | 0.5 | 0.5 | |
| 0.5 | 0.6 | 0.6 | |
| 0.6 | 0.7 | 0.7 | |
| 0.7 | 0.8 | 0.8 | |
| 0.8 | 0.9 | 0.9 | |
| 0.9 | 1 | 1 | |
| 1 | 1.1 | 1.1 | |
| 1.1 | 1.2 | 1.2 | |

As shown in Tables 4 and 5 and the graphs of FIGS. 29 and 30, Example 3 of the present invention had a much better dimensional accuracy compared to Conventional Example 2, and a good accuracy of at most ±0.3 mm was obtained.

EXAMPLE 3

Figure 36:
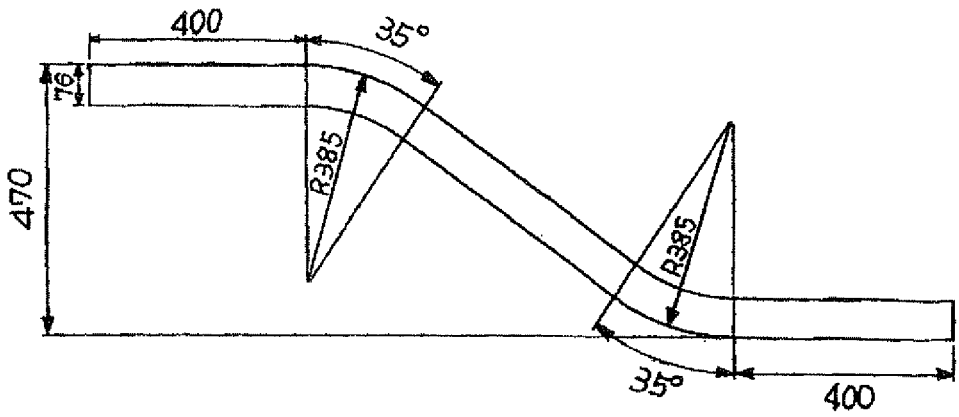
FIG. 36 is an explanatory view showing the shape of a front side member manufactured in a third embodiment.

Using a steel pipe with a wall thickness of 1.8 mm and a rectangular cross-sectional shape with a height of 50 mm and a width of 70 mm as a starting material, a front side member, which is a reinforcing member of an automobile body, having the two-dimensional shape shown in FIG. 36 was manufactured using the bending apparatus according to the present invention which was explained while referring to FIG. 1.

Figure 37:
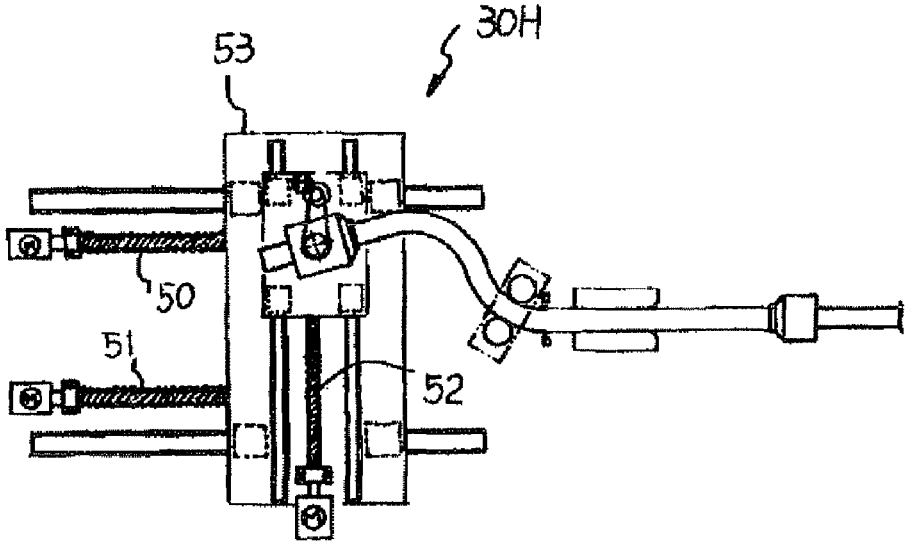
FIG. 37 is an explanatory view showing a support guide 30 used in a third embodiment.

Products of Conventional Example 3, which was manufactured without using a support guide of the present invention, and Example 4 of the present invention, which was manufactured using the support guide 30H of FIG. 37, were measured using a non-contacting three-dimensional measurement device to determine the maximum value of the deviation from a target value (dimensional accuracy).

The support guide 30H shown in FIG. 37 clamped the end of the metal material and had a mechanism which could adjust the clamping angle on a table 53. The table had precision ball screws 50-52 which were disposed in the feed direction and perpendicular to the feed direction such that the table could move by a servomotor.

Figure 31:
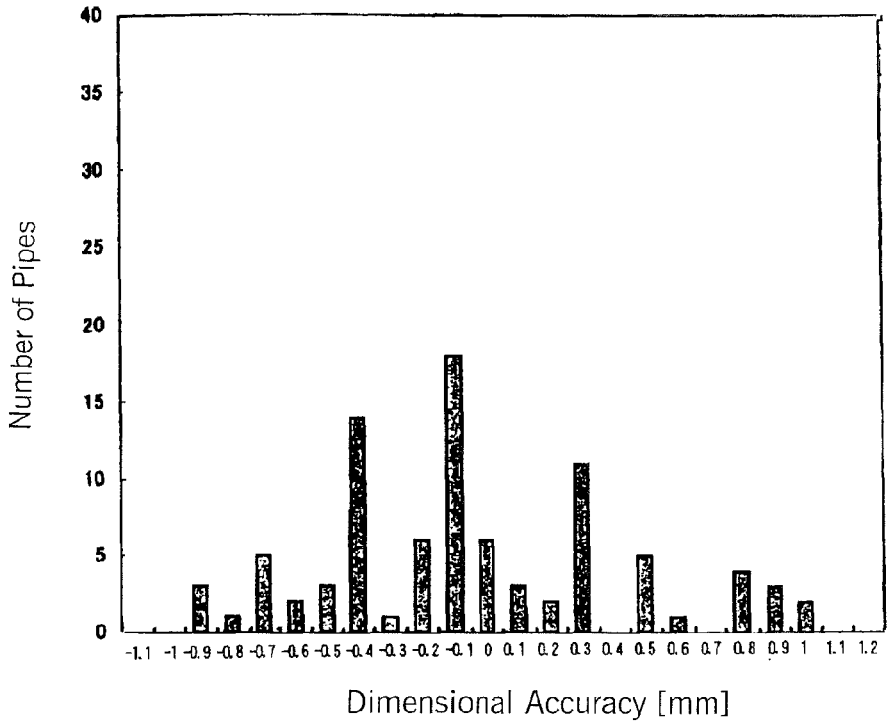
Fig. 31 PRIOR ART
FIG. 31 is a graph showing the results of Conventional Example 3.
Figure 32:
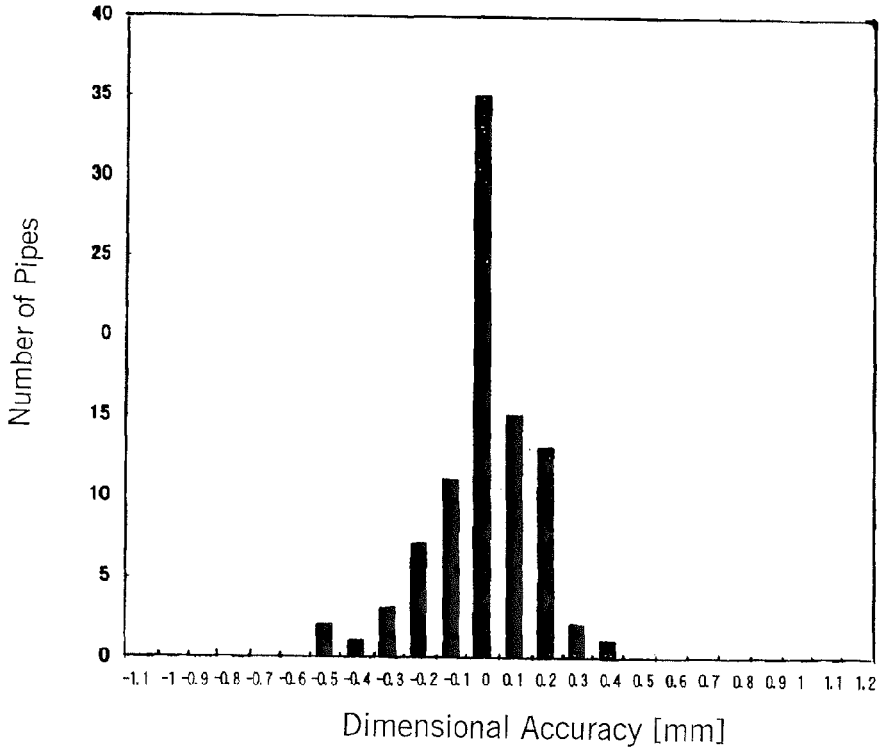
FIG. 32 is a graph showing the results of Example 4 of the present invention.
Figure 33:
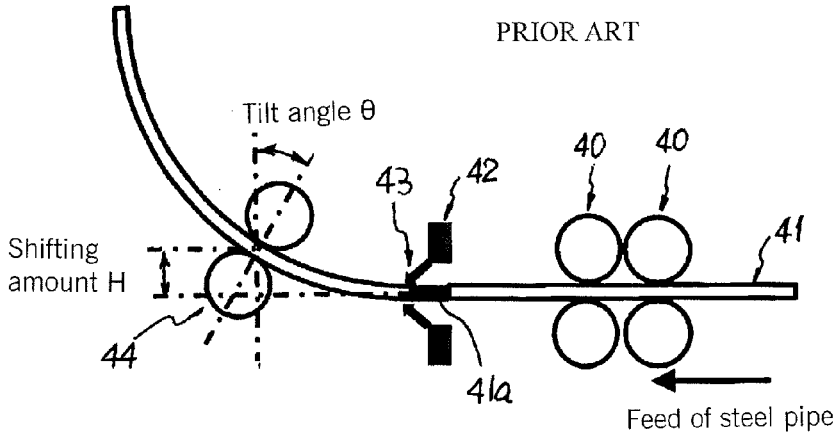
FIG. 33 is an explanatory view showing a working method disclosed in Patent Document 5.
Figure 34:
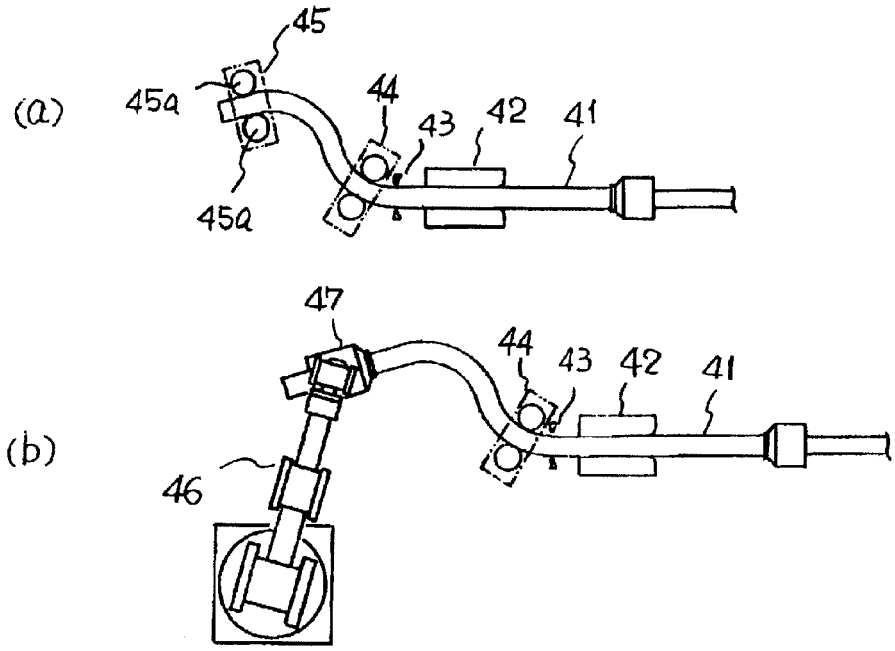
FIGS. 34(*a*) and 34(*b*) are each explanatory views showing a support guide which supports a portion of a metal material which has passed through a movable roller die.

The results of Conventional Example 3 and Example 4 of the present invention are shown in Tables 6 and 7, respectively and in the graphs of FIGS. 31 and 32.

TABLE 6

| Conventional Example 3 | | | |
|---|---|---|---|
| Accuracy | | | |
| At least | Less than | Class mark | Number |
| 0 | 0.1 | −1.1 | |
| 0.1 | 0.2 | −1 | |
| 0.2 | 0.3 | −0.9 | 3 |
| 0.3 | 0.4 | −0.8 | 1 |
| 0.4 | 0.5 | −0.7 | 5 |
| 0.5 | 0.6 | −0.6 | 2 |
| 0.6 | 0.7 | −0.5 | 3 |
| 0.7 | 0.8 | −0.4 | 14 |
| 0.8 | 0.9 | −0.3 | 1 |
| 0.9 | 1 | −0.2 | 6 |
| 1 | 1.1 | −0.1 | 18 |
| 1.1 | 1.2 | 0 | 6 |
| 1.2 | 1.3 | 0.1 | 3 |
| 1.3 | 1.4 | 0.2 | 2 |
| 1.4 | 1.5 | 0.3 | 11 |
| 1.5 | 1.6 | 0.4 | |
| | | 0.5 | 5 |
| | | 0.6 | 1 |
| | | 0.7 | |
| | | 0.8 | 4 |
| | | 0.9 | 3 |
| | | 1 | 2 |
| | | 1.1 | |
| | | 1.2 | |

TABLE 7

| Example 4 | | | |
|---|---|---|---|
| Accuracy | | | |
| At least | Less than | Class mark | Number |
| 0 | 0.1 | −1.1 | |
| 0.1 | 0.2 | −1 | |
| 0.2 | 0.3 | −0.9 | |
| 0.3 | 0.4 | −0.8 | |
| 0.4 | 0.5 | −0.7 | |
| 0.5 | 0.6 | −0.6 | |
| 0.6 | 0.7 | −0.5 | 2 |
| 0.7 | 0.8 | −0.4 | 1 |
| 0.8 | 0.9 | −0.3 | 3 |
| 0.9 | 1 | −0.2 | 7 |
| 1 | 1.1 | −0.1 | 11 |
| 1.1 | 1.2 | 0 | 35 |
| 1.2 | 1.3 | 0.1 | 15 |
| 1.3 | 1.4 | 0.2 | 13 |
| 1.4 | 1.5 | 0.3 | 2 |

TABLE 7-continued

| Example 4 | | | |
|---|---|---|---|
| Accuracy | | | |
| At least | Less than | Class mark | Number |
| 1.5 | 1.6 | 0.4 | 1 |
| | | 0.5 | |
| | | 0.6 | |
| | | 0.7 | |
| | | 0.8 | |
| | | 0.9 | |
| | | 1 | |
| | | 1.1 | |
| | | 1.2 | |

As shown in Tables 6 and 7 and the graphs of FIGS. 31 and 32, Example 4 of the present invention had greatly improved dimensional accuracy compared to Conventional Example 3, and good accuracy of at most ±0.5 mm was obtained.

The invention claimed is:

1. A method of manufacturing a product using a bending method which carries out bending downstream of a support means while feeding a metal material to be worked with a feed device from an upstream side to a downstream side and supporting the metal material in co-ordination with movement of the metal material with the support means to manufacture a product intermittently or continuously having a bent portion which is bent two-dimensionally or three-dimensionally and a quenched portion in the lengthwise direction and/or the circumferential direction in a plane crossing the lengthwise direction, characterized by locally heating a portion of the fed metal material to a temperature range in which quenching is possible with a heating means for the metal material downstream of the support means and spraying a cooling medium towards the portion of the metal material heated by the heating means with a cooling means disposed downstream of the heating means to quench at least a portion of the metal material, performing bending of the metal material which is fed in the axial direction by imparting a bending moment to the portion of the metal material which was heated by the heating means by two-dimensionally or three-dimensionally varying the position of a movable roller die which was disposed downstream of the cooling means and which had a plurality of rolls which can feed the metal material which was heated by the heating means in the axial direction, and suppressing errors in the formed product resulting from the bending by supporting a portion of the metal material which has passed through the movable roller die.

2. A method of manufacturing a product by bending as set forth in claim 1 characterized in that the cooling medium is sprayed obliquely with respect to the direction in which the metal material is fed, and the region in the axial direction of the metal material which is heated is adjusted by varying the distance of the cooling means from the metal material in a direction parallel to a direction perpendicular to the axial direction of the metal material.

3. A method of manufacturing a product by bending as set forth in claim 1 characterized in that a portion of the metal material being fed is nonuniformly heated in the circumferential direction by varying the distance of the heating means from the metal material in a direction parallel to a direction perpendicular to the axial direction of the metal material.

4. A method of manufacturing a product by bending as set forth in claim 1 characterized by heating the metal material a plurality of times with at least one preheating means for the metal material disposed upstream of the heating means.

5. A method of manufacturing a product by bending as set forth in claim 1 characterized by heating a portion of the metal material being fed nonuniformly in its circumferential direction with at least one preheating means for the metal material disposed upstream of the heating means.

6. A method of manufacturing a product by bending as set forth in claim 1 wherein at least one of the heating means, the movable roller die, the cooling means, and a portion of the metal material which has exited from the movable roller die is supported by an articulated robot which has a rotatable joint which can rotate about at least one axis.

7. A manufacturing apparatus for manufacturing a product by bending which intermittently or continuously has a bent portion which is curved two-dimensionally or three-dimensionally and quenched portion in the lengthwise direction and/or the circumferential direction in a plane crossing the lengthwise direction formed by performing bending downstream of a support means while feeding a metal material which is a material being worked and which is supported by the support means from an upstream side towards a downstream side, characterized by comprising:

a heating means for heating a portion of the metal material, said heating means surrounding the outer periphery of the metal material and being disposed downstream of the support means, and a cooling means which is disposed downstream of the heating means and which sprays a cooling medium at the portion of the metal material which was heated by the heating means to quench the heated portion of the metal material, a movable roller die which is disposed downstream of the cooling means so as to be able to change its position two-dimensionally or three-dimensionally and which has a plurality of rolls which support the metal material which was heated by the heating means so that the metal material can move in the axial direction and which performs bending of the metal material being fed in the axial direction by imparting a bending moment to the a portion of the metal material was heated by the heating means, and a support guide which is disposed downstream of the movable roller die and which suppresses errors in the metal material after the bending by supporting a portion of the metal material which has exited from the movable roller die.

8. A manufacturing apparatus for manufacturing a product by bending as set forth in claim 7 characterized in that the cooling medium is sprayed obliquely with respect to the direction in which the metal material is fed, and the distance of the cooling means from the metal material in a direction parallel to a direction perpendicular to the axial direction of the metal material can be varied.

9. A manufacturing apparatus for manufacturing a product by bending as set forth in claim 7 characterized in that the distance of the heating means from the metal material in a direction parallel to a direction perpendicular to the axial direction of the metal material can be varied.

10. A manufacturing apparatus for manufacturing a product by bending as set forth in claim 7 characterized by having at least one preheating means for the metal material provided upstream of the heating means.

11. A manufacturing apparatus for manufacturing a product by bending as set forth in claim 7 characterized by having an articulated robot having a joint which is rotatable about at least one axis and which supports at least one of the heating means, the movable roller die, the cooling means, and a portion of the metal material has exited from the movable roller die.

12. A manufacturing apparatus for manufacturing a product by bending as set forth in claim 7 characterized by having a synchronizing means which synchronizes the position of the support guide with the position of the movable roller die.

13. A continuous manufacturing line for manufacturing a product by bending characterized by comprising a seam welded pipe manufacturing line which comprises an uncoiler which continuously pays off a steel strip, a forming means which forms the uncoiled steel strip into a pipe having a predetermined cross-sectional shape, a welding means which welds both abutted edges of the steel strip and forms a continuous pipe, and a post-treatment means which cuts off a weld bead and if necessary performs post-annealing and sizing, and a manufacturing apparatus for manufacturing a product by bending as set forth in claim 7 disposed on the exit side of the post-treatment means.

14. A continuous manufacturing line for manufacturing a product by bending characterized by comprising a continuous roll-forming line which comprises an uncoiler which continuously pays off a steel strip and a forming means which forms the uncoiled steel strip into a prescribed cross-sectional shape, and a manufacturing apparatus for manufacturing a product by bending as set forth in claim 7 disposed on the exit side of the forming means.

* * * * *